US008339339B2

(12) United States Patent
Yamazaki et al.

(10) Patent No.: US 8,339,339 B2
(45) **Date of Patent: *Dec. 25, 2012**

(54) LIGHT EMITTING DEVICE, METHOD OF DRIVING THE SAME, AND ELECTRONIC DEVICE

(75) Inventors: Shunpei Yamazaki, Tokyo (JP); Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 395 days.

This patent is subject to a terminal disclaimer.

(21) Appl. No.: 10/026,406

(22) Filed: Dec. 21, 2001

(65) Prior Publication Data

US 2002/0130828 A1 Sep. 19, 2002

(30) Foreign Application Priority Data

Dec. 26, 2000 (JP) ..... 2000-394075

(51) Int. Cl.
*G09G 3/30* (2006.01)

(52) U.S. Cl. ..... 345/77; 345/82; 345/690; 345/204; 315/169.3

(58) Field of Classification Search ..... 345/55–103, 345/204–205, 690, 208–210, 214; 257/59, 257/72; 315/169.1, 169.2, 169.3, 169.4
See application file for complete search history.

(56) References Cited

U.S. PATENT DOCUMENTS 3,903,857 A * 9/1975 Honig et al. ..... 123/406.44
4,110,662 A * 8/1978 Greeneich et al. ..... 345/206
4,262,352 A * 4/1981 Kobayashi et al. ..... 368/82
4,373,415 A * 2/1983 Kondo ..... 84/655
4,574,386 A * 3/1986 Kinghorn ..... 377/121
4,651,149 A * 3/1987 Takeda et al. ..... 345/90
4,996,523 A * 2/1991 Bell et al. ..... 345/77
5,225,823 A * 7/1993 Kanaly ..... 345/89
5,302,966 A * 4/1994 Stewart ..... 345/76
5,712,652 A * 1/1998 Sato et al. ..... 345/90
5,798,746 A * 8/1998 Koyama ..... 345/98
5,945,972 A * 8/1999 Okumura et al. ..... 345/98
5,977,940 A 11/1999 Akiyama et al.
5,990,857 A * 11/1999 Kubota et al. ..... 345/98
6,005,558 A * 12/1999 Hudson et al. ..... 345/204
6,124,971 A * 9/2000 Ouderkirk et al. ..... 359/487
6,356,028 B1 * 3/2002 Legagneux et al. ..... 315/169.1
6,563,480 B1 * 5/2003 Nakamura ..... 345/82

(Continued)

FOREIGN PATENT DOCUMENTS

EP 1 098 290 A2 5/2001

(Continued)

OTHER PUBLICATIONS

JP 11-295700 English Translation, Kurumisawa et al, Sep. 19, 1999, pp. 1-24.*

(Continued)

*Primary Examiner* — Jeff Piziali
(74) *Attorney, Agent, or Firm* — Husch Blackwell LLP

(57) ABSTRACT

A light emitting device in which flickers on a screen can be reduced is provided. In the present invention, each pixel has memories and at the start of a frame period, all of bits of digital vide signals are written in the memories. Then, in the frame period, according to information in all of the bit of digital video signals, the light emitting device sequently emit a light in a determined period.

5 Claims, 21 Drawing Sheets

U.S. PATENT DOCUMENTS

| | | | | |
|---|---|---|---|---|
| 6,583,775 | B1 * | 6/2003 | Sekiya et al. | 345/76 |
| 6,636,191 | B2 * | 10/2003 | Cok | 345/82 |
| 6,693,616 | B2 | 2/2004 | Koyama et al. | 345/98 |
| 6,730,966 | B2 | 5/2004 | Koyama | 257/350 |
| 6,731,272 | B2 * | 5/2004 | Huang | 345/204 |
| 6,753,834 | B2 * | 6/2004 | Mikami et al. | 345/76 |
| 6,819,317 | B1 * | 11/2004 | Komura et al. | 345/204 |
| 6,853,370 | B2 * | 2/2005 | Numao | 345/204 |
| 6,975,298 | B2 * | 12/2005 | Koyama et al. | 345/98 |
| 6,989,824 | B1 * | 1/2006 | Ishii et al. | 345/204 |
| 2002/0018029 | A1 | 2/2002 | Koyama | 345/39 |
| 2002/0021274 | A1 * | 2/2002 | Koyama et al. | 345/98 |
| 2002/0021295 | A1 | 2/2002 | Koyama et al. | 345/205 |
| 2002/0024054 | A1 | 2/2002 | Koyama et al. | 257/84 |
| 2002/0024485 | A1 | 2/2002 | Koyama | 345/87 |
| 2002/0036604 | A1 | 3/2002 | Yamazaki et al. | 345/76 |
| 2002/0036611 | A1 | 3/2002 | Ishii | |
| 2002/0041266 | A1 | 4/2002 | Koyama et al. | 345/87 |
| 2002/0113763 | A1 * | 8/2002 | Koyama | 345/87 |

FOREIGN PATENT DOCUMENTS

| | | | |
|---|---|---|---|
| EP | 1 182 636 | A2 | 2/2002 |
| EP | 1 182 638 | A2 | 2/2002 |
| EP | 1 187 090 | A2 | 3/2002 |
| JP | 08-241048 | * | 9/1996 |
| JP | 9-243994 | | 9/1997 |
| JP | 11-002797 | | 1/1999 |
| JP | 11-295700 | | 10/1999 |
| JP | 2002-082653 | | 3/2002 |
| JP | 2002-140034 | | 5/2002 |
| JP | 2002-140051 | | 5/2002 |

OTHER PUBLICATIONS

"Natural Number" Definition, Dictionary.com Unabridged. Random House, Inc., Collins English Dictionary—Complete & Unabridged 10th Edition. HarperCollins Publishers., The Free On-line Dictionary of Computing. Denis Howe., pp. 1-2, Jul. 27, 2011.*

Tsutsui, Tetsuo, et al, "Electroluminescence in Organic Thin Films," Photochemical Processes in Organized Molecular Systems, pp. 437-450, 1991.

Baldo, M.A. et al, "Highly Efficient Phosphorescent Emission from Organic Electroluminescent Devices," Nature, vol. 395, pp. 151-154, Sep. 10, 1998.

Baldo, M.A. et al, "Very High-Efficiency Green Organic Light-Emitting Devices Based on Electrophosphorescence," Applied Physics Letters, vol. 75, No. 1, pp. 4-6, Jul. 5, 1999.

Tsutsui, T. et al, "High Quantum Efficiency in Organic Light-Emitting Devices with Iridium-Complex as a Triplet Emissive Center," Japanese Journal of Applied Physics, vol. 38, part 2, No. 12B, pp. L 1502-L 1504, Dec. 15, 1999.

* cited by examiner

LIGHT EMITTING DEVICE, METHOD OF DRIVING THE SAME, AND ELECTRONIC DEVICE

BACKGROUND OF THE INVENTION

1. Field of the Invention

The present invention relates to a display panel in which a light emitting element is formed over a substrate and is sandwiched between the substrate and a cover member. The invention also relates to a display module obtained by mounting IC to the display panel. In this specification, the display panel and the display module are called by a generic term, light emitting device. The present invention also relates to a method of driving the light emitting device and to electronic device using the light emitting device.

2. Description of the Related Art

Being self-luminous, light emitting elements eliminate the need for back light necessary in liquid crystal display devices (LCDs) and therefore can make thinner devices. In addition, light emitting elements have higher visibility and no limitation in terms of viewing angle, and these are the reasons for attention that light emitting devices using light emitting elements are receiving in recent years as display devices to replace CRTs and LCDs.

A light emitting element has a layer containing an organic compound that provides luminescence (electro luminescence) generated upon application of electric field (hereinafter referred to as organic compound layer), as well as an anode layer and a cathode layer. Luminescence provided by organic compounds is divided into light emission upon return to base state from singlet excitation (fluorescence) and light emission upon return to base state from triplet excitation (phosphorescence). One or both of the fluorescence and phosphorescence can be used in a light emitting device of the present invention.

All the layers that are provided between an anode and a cathode of the light emitting element are organic compound layers in this specification. Specifically, the organic compound layer includes a light emitting layer, a hole injection layer, an electron injection layer, a hole transporting layer, an electron transporting layer, etc. A basic structure of a light emitting element is a laminate of an anode, a light emitting layer, and a cathode layered in this order. The basic structure can be modified into a laminate of an anode, a hole injection layer, a light emitting layer, and a cathode layered in this order, or a laminate of an anode, a hole injection layer, a light emitting layer, an electron transporting layer, and a cathode layered in this order.

In this specification, making a light emitting element to emit light is expressed as driving the light emitting element. The light emitting element as defined herein is an element that is composed of an anode, an organic compound layer, and a cathode.

Methods of driving a light emitting device having a light emitting element are roughly divided into analog driving methods and digital driving methods. Digital driving is deemed more promising in view of transition from analog broadcasting to digital broadcasting in recent years since it enables the light emitting device to display an image using a digital video signal that carries image information as it is without converting the signal into an analog signal.

Among the driving methods that obtain gradation display by binary voltages of digital video signals, there are an area division driving method and a time division driving method.

The area division driving method is a driving method in which gradation display is obtained by dividing one pixel into a plurality of sub-pixels and driving the sub-pixels individually in accordance with digital video signals. In the area division driving method, one pixel has to be divided into plural sub-pixels and each sub-pixel has to have its own pixel electrode in order to drive the sub-pixels individually. The area division driving method is therefore inconvenient in that the pixel structure is complicated.

On the other hand, the time division driving method is a driving method in which lengths of time a pixel is lit are controlled to obtain gradation display. Specifically, one frame period is divided into a plurality of subt-frame periods. In each sub-frame period, to be lit or not is determined for the respective pixel in accordance with digital video signals. The accumulated lengths of sub-frame periods during which a pixel is lit with respect to the length of the entire sub-frame periods in one frame period determine the gradation of that pixel.

Generally, an organic compound layer has faster response speed than a liquid crystal and therefore a light emitting element is suitable for time division driving.

A pixel portion of a light emitting device has a plurality of pixels. A circuit diagram of a pixel 9004 in a common light emitting device is shown in FIG. 16.

The pixel 9004 has one of source signal lines (source signal line 9005), one of power supply lines (power supply line 9006), and one of gate signal lines (gate signal line 9007). The pixel 9004 also has a switching TFT 9008 and a current controlling TFT 9009.

The switching TFT 9008 has a gate electrode connected to the gate signal line 9007. The switching TFT 9008 also has a source region and a drain region one of which is connected to the source signal line 9005 and the other of which is connected to a gate electrode of the current controlling TFT 9009 and to a capacitor 9010. Each pixel in the pixel portion has one capacitor.

The capacitor 9010 is provided to hold the gate voltage (the difference in electric potential between the gate electrode and a source region) of the current controlling TFT 9009 when the switching TFT 9008 is OFF.

The current controlling TFT 9009 has a source region and a drain region one of which is connected to the power supply line 9006 and the other of which is connected to a light emitting element 9011. The power supply line 9006 is connected to the capacitor 9010.

The light emitting element 9011 is composed of an anode, a cathode, and an organic compound layer placed between the anode and the cathode. If the anode is in contact with the source region or the drain region of the current controlling TFT 9009, the anode serves as a pixel electrode whereas the cathode serves as an opposite electrode. On the other hand, the cathode serves as the pixel electrode whereas the anode serves as the opposite electrode if the cathode is in contact with the source region or the drain region of the current controlling TFT 9009.

The opposite electrode of the light emitting element 9011 receives a given electric potential (opposite electric potential). The power supply line 9006 receives a given electric potential (power supply electric potential). The power supply electric potential and the opposite electric potential are provided by a power source placed in an IC external to the display device.

The operation of the pixel shown in FIG. 16 is described next. The description on the operation of the light emitting device shown in FIG. 16 is given while distinguishing the operation during a writing period and the operation during a display period from each other.

In a writing period, the opposite electric potential and the power supply electric potential are kept at the same level. A selection signal is inputted to the gate signal line 9007 to turn the switching TFT 9008 ON. Of n bit digital signals carrying image information (hereinafter referred to as digital video signals) and inputted to the source signal line 9005, digital video signals equivalent to one bit are inputted to the gate electrode of the current controlling TFT 9009 through the switching TFT 9008. The digital video signals inputted to the gate electrode of the current controlling TFT 9009 contain information, which is '1' or '0' and is used to control switching of the current controlling TFT 9009.

When digital video signals equivalent to one bit are inputted to the gate electrode of the current controlling TFT 9009 in every pixel, the writing period is ended to start a display period.

In a display period, there is an electric potential difference between the opposite electric potential and the power supply electric potential. When inputted digital video signals turn the current controlling TFT 9009 OFF, the electric potential of the power supply line 9006 is not given to the pixel electrode of the light emitting element 9011 and therefore the light emitting element 9011 does not emit light. On the other hand, when the current controlling TFT 9009 is turned ON, the power supply electric potential is given to the pixel electrode of the light emitting element 9011 and the electric potential difference between the opposite electric potential and the power supply electric potential causes the light emitting element 9011 to emit light.

The above operation is conducted for each set of one bit digital video signals to alternate a writing period with a display period. The accumulated lengths of display periods during which a light emitting element of a pixel emits light determine the gradation of that pixel.

FIG. 17 shows points at which writing periods and display periods are started in one frame period in the light emitting device that has the pixel illustrated in FIG. 16. The axis of an abscissa indicates time and the axis of an ordinate indicates the luminance of the light emitting element of the pixel. To simplify the explanation, the device is driven using 4 bit digital video signals and the light emitting element emits light in all of the display periods in FIG. 17.

One frame period has four writing periods Ta1 to Ta4 and four display periods Tr1 to Tr4 in correspondence with each bit of 4 bit digital video signals.

The light emitting element 9011 does not emit light in a writing period. Therefore, the luminance of the light emitting element 9011 is 0 in all of the writing periods Ta1 to Ta4.

When the display periods Tr1 to Tr4 are started, the light emitting element 9011 of the pixel starts emitting light (luminous state). As the display periods Tr1 to Tr4 are ended, the light emitting element 9011 stops emitting light (nonluminous state).

FIG. 17 shows points (timings) of starting display periods and writing periods in one pixel. Considered here is a case in which the operation shown in FIG. 17 is conducted in every pixel of the pixel portion.

After the operation shown in FIG. 17 is completed in every pixel, a writing period is ended to start a display period. At this point, a current flows into the light emitting element 9011 in every pixel at once. Thus, the amount of current flowing in the power supply line 9006 is increased sharply.

Because of the wiring line resistance of the power supply line 9006, the demand for current to be supplied to the light emitting element 9011 of the pixel 9004 temporarily surpasses the ability of the power supply line and the light emitting element 9011 fails to reach the designed luminance early in the display period. In FIG. 17, the ideal luminance of the light emitting element 9011 is indicated by the solid line and the actual luminance thereof is indicated by the dotted line.

This phenomenon is not limited to the case where all of the pixels in the pixel portion emit light simultaneously but could happen when more than one pixels out of all the pixels in the pixel portion are to emit light concurrently, though to varying degrees.

In the driving method of FIG. 17 using 4 bit digital video signals, the end of a writing period followed by the start of a display period takes place four times in one frame period. Each time a writing period is ended to start a display period, the luminance of the light emitting element is lowered temporarily to cause an image on the screen to flicker.

One of other driving methods than the one shown in FIG. 17 is a driving method in which the power supply electric potential and the opposite electric potential are kept constant all the time. In this driving method, the light emitting element emits light not only in a display period but also in a writing period. Accordingly, if the current controlling TFT is always ON, light emitting elements of plural pixels do not start emitting light simultaneously.

However, depending on the gradation of pixels, even this driving method allows light emitting elements of plural pixels to simultaneously start emitting light, which may take place several times in one frame period. Each time the light emitting elements start emitting light simultaneously, the luminance of the light emitting elements is lowered temporarily.

SUMMARY OF THE INVENTION

The present invention has been made in view of the above problems, and an object of the present invention is therefore to control the number of times the luminance of light emitting elements is temporarily lowered because light emitting elements of plural pixels become from non-luminous state to luminous state and to reduce flickers on the screen.

To reduce flickers on the screen, the present inventors deem it sufficient to allow a light emitting element of each pixel to become from non-luminous state to luminous state (start emitting light) not more than once in a frame period whichever gradation is to be obtained.

The present invention achieves this by providing storing means such as a memory in each pixel and writing digital video signals of every bit in the storing means at the start of a frame period. Also provided is controlling means for calculating lengths of periods in which a light emitting element emits light (light emission periods) in the frame period in accordance with the digital video signals written in the storing means, and for causing a current to flow into the light emitting element in the calculated light emission periods. The above structure makes it possible to cause a light emitting element to emit light continuously only for a given period in one frame period.

Therefore, light emitting elements of plural pixels simultaneously become from non-luminous state to luminous state (start emitting light) not more than once in one frame period whichever gradation is to be obtained. The number of times the luminance of light emitting elements is temporarily lowered, which is caused by light emitting elements of plural pixels simultaneously become from non-luminous state to luminous state (starting light emission), is thus controlled and flickers on the screen can be reduced. Also, animation pseudocontour can be avoided because a light emitting element does not emit light in consecutive periods of consecutive frame periods when an intermediate gradation is to be obtained.

The structure of the present invention will be shown below.

The invention disclosed in this specification relates to a light emitting device characterized by having in a pixel a light emitting element, means for storing digital video signals, and means for determining periods in which the light emitting element emits light in accordance with image information of the stored digital video signals.

The invention disclosed in this specification relates to a light emitting device having in a pixel a light emitting element, means for storing digital video signals, and means for determining periods in which the light emitting element emits light in accordance with image information of the stored digital video signals, characterized in that the periods in which the light emitting element emits light turn up successively in one frame period.

The invention disclosed in this specification relates to a light emitting device comprising a plurality of pixels, the pixels each having n first memories, n second memories, a display signal generating unit, a counter circuit, and a light emitting element, characterized in that:

each bit of n bit digital video signals is sequentially written in each of the n first memories;

each bit of n bit digital video signals, which have been written in each of the n first memories, is written in each of the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit; and the light emitting element emits light only during a period that starts with the start of output of the n counter signals and ends as information of each bit of the n bit digital video signals inputted to the display signal generating unit matches information each of the n counter signals.

The invention disclosed in this specification relates to a light emitting device comprising a plurality of pixels, the pixels each having n first memories, n second memories, n first switching TFTs (thin film transistors), n second switching TFTs, a display signal generating unit, a counter circuit, and a light emitting element, characterized in that:

the n first switching TFTs are sequentially turned ON to write each bit of the n bit digital video signals in each of the n first memories;

the n second switching TFTs are turned ON at once to write each bit of n bit digital video signals, which have been written in each of the n first memories, in each of the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit; and the light emitting element emits light only during a period that starts with the start of output of the n counter signals and ends as information of each bit of the n bit digital video signals inputted to the display signal generating unit matches information each of the n counter signals.

The invention disclosed in this specification relates to a light emitting device comprising a plurality of pixels, the pixels each having n first memories, n second memories, n first switching TFTs, n second switching TFTs, a display signal generating unit, a counter circuit, a current controlling TFT, and a light emitting element, characterized in that:

the n first switching TFTs are sequentially turned ON to write each bit of the n bit digital video signals in each of the n first memories;

the n second switching TFTs are turned ON at once to write each bit of n bit digital video signals, which have been written in each of the n first memories, in each of the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit, display signals outputted from the display signal generating unit turn the current controlling TFT ON only during a period that starts with the start of output of the n counter signals and ends as information of each bit of the n bit digital video signals inputted to the display signal generating unit matches information of each of the n counter signals; and the light emitting element emits light when the current controlling TFT is turned ON.

The invention disclosed in this specification relates to a light emitting device comprising a plurality of pixels, the pixels each having n first memories, n second memories, a display signal generating unit, a counter circuit, and a light emitting element, characterized in that:

each bit of n bit digital video signals is sequentially written in each of the n first memories;

each bit of n bit digital video signals, which have been written in each of the n first memories, is written in each of the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit;

the display signal generating unit has a first function of comparing information of each bit of the n bit digital video signals inputted to the display signal generating unit with information of each of the n counter signals inputted to the display signal generating unit to judge whether or not these pieces of information match; and a second function of making the light emitting element emit only during a period that starts with the start of output of the n counter signals and ends as information of each bit of the n bit digital video signals inputted to the display signal generating unit matches information of each of the n counter signals.

The invention disclosed in this specification relates to a light emitting device comprising a plurality of pixels, the pixels each having n first memories, n second memories, n first switching TFTs, n second switching TFTs, a display signal generating unit, a counter circuit, and a light emitting element, characterized in that:

the n first switching TFTs are sequentially turned ON to write each bit of the n bit digital video signals in each of the n first memories;

the n second switching TFTs are turned ON at once to write each bit of n bit digital video signals, which have been written in each of the n first memories, in each of the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit; and the display signal generating unit has, a first function of comparing information of each bit of the n bit digital video signals inputted to the display signal generating unit with information of each of the n counter signals inputted to the display signal generating unit to judge whether or not these pieces of information match; and a second function of making the light emitting element emit only during a period that starts with the start of output of the n counter signals and ends as information of each bit of the n bit digital video signals inputted to the display signal generating unit matches information of each of the n counter signals.

The invention disclosed in this specification relates to a light emitting device comprising a plurality of pixels, the pixels each having n first memories, n second memories, n first switching TFTs, n second switching TFTs, a display signal generating unit, a counter circuit, a current controlling TFT, and a light emitting element, characterized in that:

the n first switching TFTs are sequentially turned ON to write each bit of n bit digital video signals in each of the n first memories;

the n second switching TFTs are turned ON at once to write each bit of the n bit digital video signals, which have been written in each of the n first memories, in the n second memories at once;

each bit of the n bit digital video signals, which have been written in each of the n second memories, is inputted to the display signal generating unit;

output of n counter signals having different frequencies from the counter circuit is started in response to a reset signal;

the n counter signals are inputted to the display signal generating unit;

the display signal generating unit has, a first function of comparing information of each bit of the n bit digital video signals inputted to the display signal generating unit with information of each of the n counter signals inputted to the display signal generating unit to judge whether or not these pieces of information match; and a second function of turning the current controlling TFT ON only during a period that starts with the start of output of the n counter signals and ends as information of each bit of the n bit digital video signals inputted to the display signal generating unit matches information of each of the n counter signals; and the light emitting element emits light when the current controlling TFT is turned ON.

The present invention may be characterized in that the current controlling TFT is an n-channel TFT.

The present invention may be characterized in that:

the display signal generating unit has a NOR and n exclusive ORs;

of two input terminals of each of the n exclusive ORs, one input terminal is inputted with each bit of the n bit digital video signals inputted to the display signal generating unit, whereas the other input terminal is inputted with the n counter signals;

each of the output terminals of the n exclusive ORs is all connected to an input terminal of the NOR; and information of signals outputted from an output terminal of the NOR is used to judge whether or not information of each bit of the n bit digital video signals inputted to the display signal generating unit matches information of each the n counter signals inputted to the display signal generating unit.

The present invention may be characterized in that:

the display signal generating unit has an R-S flip-flop circuit; of two input terminals of the R-S flip-flop circuit, one input terminal is inputted with reset signals whereas the other input terminal is inputted with signals that contain information about whether or not information of each bit of the n bit digital video signals inputted to the display signal generating unit matches information of each of the n counter signals inputted to the display signal generating unit; and signals outputted from an output terminal of the R-S flip-flop circuit causes the light emitting element to emit light only during a period that starts with the start of output of the n counter signals and ends as information of each unit of the n bit digital video signals inputted to the display signal generating unit matches information of each of the n counter signals.

The present invention may be characterized in that the first memories or second memories are SRAMs.

The present invention may be characterized in that clock signals are inputted to the counter circuit and the frequencies of the n counter signals arranged in order from the highest to the lowest correspond to $1/2, 1/2^2, \ldots, 1/2^n$ of the frequencies of the clock signals, respectively.

The present invention may be used for an electronic apparatus characterized by comprising the light emitting device.

The present invention may be used for an electronic apparatus selected from the group consisting of an electroluminescence display device, a digital still camera, a notebook computer, a mobile computer, an image reproducing device, a goggle type display, a video camera, and a cellular phone.

DETAILED DESCRIPTION OF THE PREFERRED EMBODIMENTS

Embodiment Mode

The structure of a light emitting device of the present invention will be described below. For the sake of simplicity, the description is given taking as an example a light emitting device for 4 bit digital video signals. However, the present invention is not limited to 4 bit digital video signals.

A pixel portion of the light emitting device of the present invention is provided with source signal lines S1 to Sx, power supply lines V1 to Vx, latch signal lines LAT1 to LATy, and gate signal lines G1_1 to G1_4, . . . , Gy_1 to Gy_4. The number of source signal lines and the number of power supply lines may not always match. The number of gate signal lines may not always correspond to a number obtained by multiplying the number of latch signal lines by the bit number of digital video signals.

Figure 1:
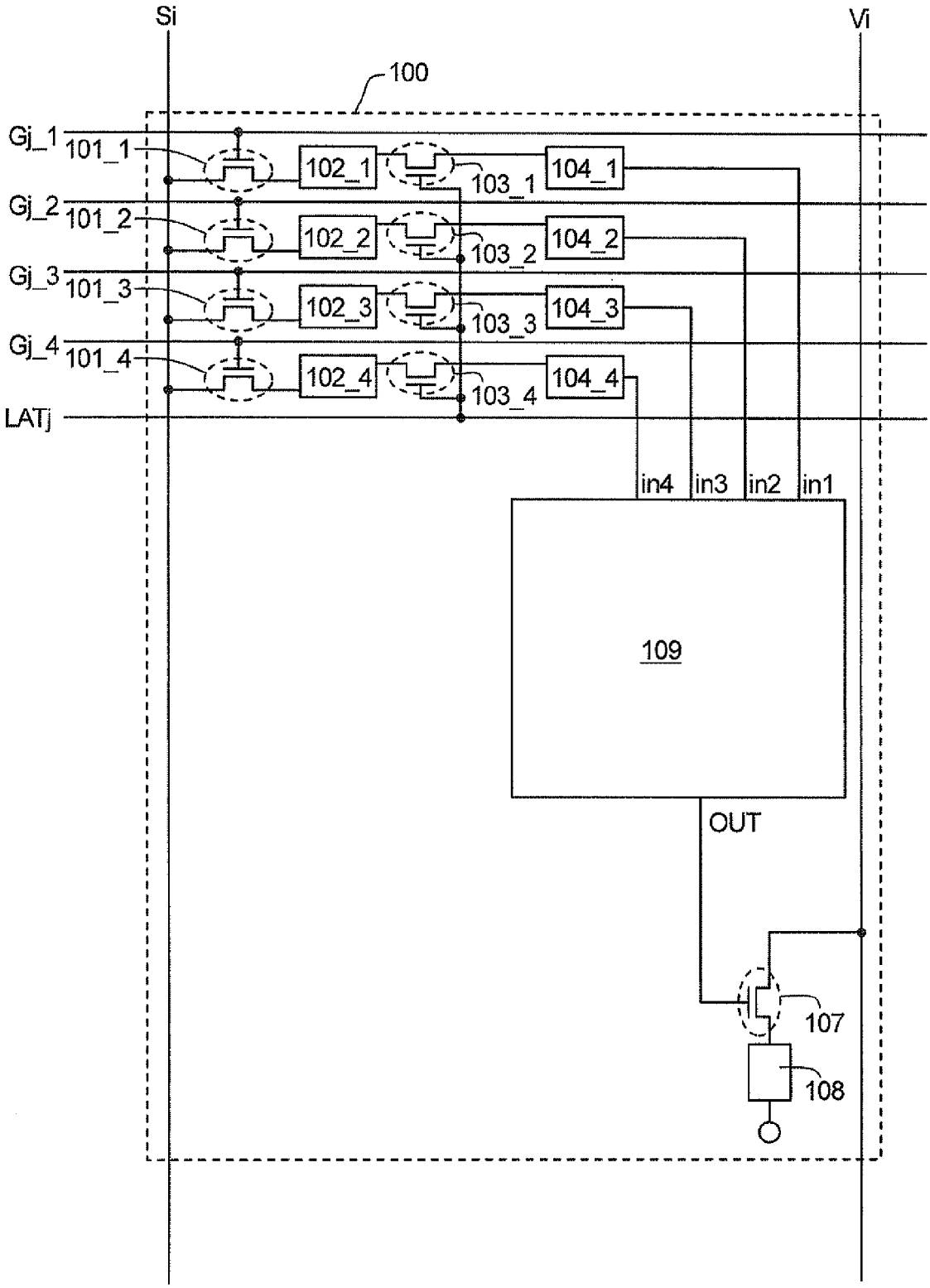
FIG. 1 is a circuit diagram of a pixel in a light emitting device of the present invention.

In the light emitting device of the present invention, the pixel portion has a plurality of pixels, which form a matrix. FIG. 1 shows the structure of one of the pixels in the light emitting device of the present invention.

A pixel 100 shown in FIG. 1 has one source signal line Si (i is an arbitrary number ranging from 1 to x), one power supply line Vi, and one latch signal line LATj (j is an arbitrary number ranging from 1 to y). The pixel also has gate signal lines Gj_1 to Gj_4 and the number of gate signal lines is the same as the bit number of the digital video signals (4, in this embodiment mode).

Each of the pixel 100 has first switching TFTs 101_1 to 101_4, first memories 102_1 to 102_4, second switching TFTs 103_1 to 103_4, and second memories 104_1 to 104_4, and the number of first switching TFTs, the number of first memories, the number of second switching TFTs, and the number of second memories are the same as the bit number of the digital video signals (4, in this embodiment mode).

The pixel 100 also has a light emitting element driving unit 109, a current controlling TFT 107, and a light emitting element 108. The light emitting element driving unit 109 is a unit for generating signals that turn the current controlling TFT 107 ON only for a period determined by image information of digital video signals.

Gate electrodes of the first switching TFTs 101_1 to 101_4 are connected to the gate signal lines Gj_1 to Gj_4, respectively. To elaborate, the gate electrode of the first switching TFT 101_1 is connected to the gate signal line Gj_1. The gate electrode of the first switching TFT 101_2 is connected to the gate signal line Gj_2. The gate electrode of the first switching TFT 101_3 is connected to the gate signal line Gj_3. The gate electrode of the first switching TFT 101_4 is connected to the gate signal line Gj_4.

Source regions or drain regions of the first switching TFTs 101_1 to 101_4 are connected to the source signal line Si, respectively. Of the source regions and the drain regions of the first switching TFTs, regions that are not connected to the source signal line Si are connected to input terminals of the first memories 102_1 to 102_4, respectively. To elaborate, one of the source region and the drain region of the first switching TFT 101_1 is connected to the source signal line Si whereas the other is connected to the input terminal of the first memory 102_1. One of the source region and the drain region of the first switching TFT 101_2 is connected to the source signal line Si whereas the other is connected to the input terminal of the first memory 102_2. One of the source region and the drain region of the first switching TFT 101_3 is connected to the source signal line Si whereas the other is connected to the input terminal of the first memory 102_3. To elaborate, one of the source region and the drain region of the first switching TFT 101_4 is connected to the source signal line Si whereas the other is connected to the input terminal of the first memory 102_4.

Gate electrodes of the second switching TFTs 103_1 to 103_4 are connected to the latch signal line LATj.

Source regions or drain regions of the second switching TFTs 103_1 to 103_4 are connected to output terminals of the first memories 102_1 to 102_4, respectively. Of the source regions and the drain regions of the second switching TFTs, regions that are not connected to the output terminals of the first memories are connected to input terminals of the second memories 104_1 to 104_4, respectively. To elaborate, one of the source region and the drain region of the second switching TFT 103_1 is connected to the output terminal of the first memory 102_1 whereas the other is connected to the input terminal of the second memory 104_1. One of the source region and the drain region of the second switching TFT 103_2 is connected to the output terminal of the first memory 102_2 whereas the other is connected to the input terminal of the second memory 104_2. One of the source region and the drain region of the second switching TFT 103_3 is connected to the output terminal of the first memory 102_3 whereas the other is connected to the input terminal of the second memory 104_3. One of the source region and the drain region of the second switching TFT 103_4 is connected to the output terminal of the first memory 102_4 whereas the other is connected to the input terminal of the second memory 104_4.

The light emitting element driving unit 109 has input terminals (in1 to in4) and the number of input terminals is the same as the bit number of the digital video signals (4, in this embodiment mode). The input terminals are connected to output terminals of the second memories 104_1 to 104_4 on a one to one basis.

An output terminal (out) of the light emitting element driving unit 109 is connected to a gate electrode of the current controlling TFT 107. The current controlling TFT 107 has a source region and a drain region one of which is connected to the power supply line Vi and the other of which is connected to a pixel electrode of the light emitting element 108.

The light emitting element 108 has an anode, a cathode, and an organic compound layer interposed between the anode and the cathode. When the anode serves as the pixel electrode, the current controlling TFT 107 is desirably a p-channel TFT. On the other hand, when the cathode is used as the pixel electrode, the current controlling TFT 107 is desirably an n-channel TFT. The cathode is called an opposite electrode when the anode is used as the pixel electrode. The anode is called an opposite electrode when the cathode is used as the pixel electrode.

In the light emitting device of the present invention each pixel has more TFTs than a pixel does in a general light emitting device and therefore it is preferred to lead light that the light emitting element 108 emits out of the display panel from the opposite electrode side in view of efficiency in taking out light. Therefore, the opposite electrode is preferably the anode and, in this case, the current controlling TFT 107 is desirably an n-channel TFT. However, the present invention is not limited thereto. The opposite electrode may be the cathode and the current controlling TFT 107 is desirably a p-channel TFT in this case.

Described next is the operation of the light emitting device of the present invention. The description on the operation of the light emitting device of the present invention is given while distinguishing the operation during a writing period Ta, the operation during a light emission period Ts, and the operation during a non-light emission period Tb from one another.

In the writing period Ta, digital video signals of all bits (1 to 4 bits in this embodiment mode) are successively inputted and held in the first memories of every pixel provided in the pixel portion of the light emitting device. Based on image information of the inputted digital video signals, the light emitting element driving unit 109 determines lengths of the light emission period Ts and the non-light emission period Tb. The light emitting element of each pixel emits light in the light emission period Ts and does not emit light in the non-light emission period Tb.

Figure 2:
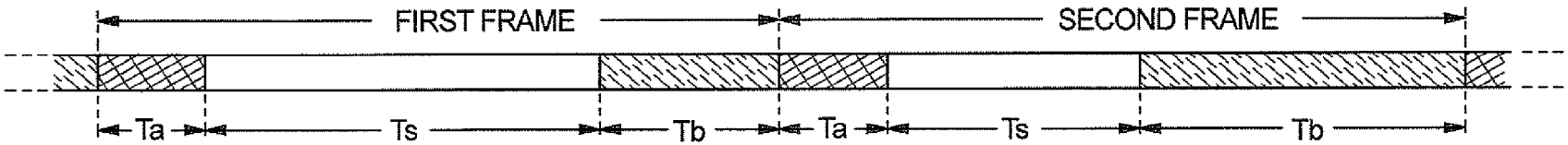
FIG. 2 is a diagram showing a method of driving a light emitting device of the present invention.

Details on the operation of the light emitting device of the present invention will be given below with reference to FIGS. 1 and 2. FIG. 2 shows points (turnings) at which the writing period Ta, the light emission period Ts, and the non-light emission period Tb are started in the pixel illustrated in FIG. 1.

First, as the writing period Ta is started, a signal (selection signal) is inputted to the gate signal line G1_1 to select the gate signal line G1_1. A signal line being selected means in this specification that TFTs whose gate electrodes are connected to that signal line are all turned ON. When the gate signal line G1_1 is selected, every first switching TFT 101_1 whose gate electrode is connected to the gate signal line G1_1 is turned ON.

Then, digital video signals equivalent to one bit are inputted to each of the source signal lines S1 to Sx to be inputted to the input terminal of the first memnory 102_1 through the first switching TFT 101_1 that has been turned ON. The inputted digital video signals equivalent to one bit are held in the first memory 102_1. Inputting and holding a signal in a memory is expressed herein as writing a signal in a memory.

When the gate signal line G1_1 is no longer selected, a selection signal is inputted to select the gate signal line G1_2. As the gate signal line G1_2 is selected, every first switching TFT 101_2 whose gate electrode is connected to the gate signal line G1_2 is turned ON.

Then, digital video signals equivalent to the next one bit are inputted to each of the source signal lines S1 to Sx to be inputted to the input terminal of the first memory 102_2 through the first switching TFT 101_2 that has been turned ON. The inputted digital video signals equivalent to one bit are held in the first memory 102_2.

Then, the gate signal lines G1_3 and G1_4 are selected in order and the same operation is conducted. As a result, the first set of one bit digital video signals are inputted and held in the first memory 102_1 of the pixel having the gate signal line G1_1, the second set of one bit digital video signals are inputted and held in the first memory 102_2 of the pixel having the gate signal line G1_2, the third set of one bit digital video signals are inputted and held in the first memory 102_3 of the pixel having the gate signal line G1_3, and the fourth set of one bit digital video signals are inputted and held in the first memory 102_4 of the pixel having the gate signal line G1_4. Thus, 4 bit digital video signals are inputted to the first memories 102_1 to 102_4 of the pixels on Line One.

Next, the gate signal lines G2_1 to G2_4 are selected in order and similarly the first to fourth sets of one bit digital video signals of 4 bit digital video signals are inputted to the first memories 102_1 to 102_4, respectively, in the pixels on Line Two.

Subsequently, the gate signal lines G3_1 to G3_4, . . . , Gy_1 to Gy_4 are selected in order and similarly the first to fourth sets of one bit digital video signals of 4 bit digital video signals are inputted to the first memories 102_1 to 102_4, respectively, in the pixels on Line Three to Line y. In this specification, a digital video signal being inputted to a pixel means that a digital video signal is inputted to an input terminal of a first memory of a pixel.

After digital video signals are inputted to all of the pixels, the writing period Ta is ended to start the light emission period Ts.

As the light emission period Ts is started, latch signals are inputted to the latch signal lines LAT1 to LATy to turn the second switching TFTs 103_3 to 103_4 of every pixel ON at once.

Through the second switching TFTs 103_1 to 103_4 that have been turned ON, the first to fourth sets of one bit digital video signals held in the first memories 102_1 to 102_4, respectively, are inputted to input terminals of the second memories 104_1 to 104_4, respectively. Thus the first to fourth sets of one bit digital video signals of 4 bit digital video signals are held in the second memories 104_1 to 104_4, respectively.

The digital video signals held in the second memories 104_1 to 104_4 are respectively inputted to the input terminals (in1 to in4) of the light emitting element driving unit 109. The number of input terminals in the light emitting element driving unit 109 is the same as the bit number of the digital video signals (4, in this embodiment mode).

A digital video signal carries as information the gradation number of a pixel in a specific frame period. The light emitting element driving unit 109 calculates the length of the light emission period Ts that can provide a given gradation based on the 4 bit digital video signals inputted from the input terminals (in1 to in4).

A signal that turns the current controlling TFT 107 ON (display signal) only during the light emission period Ts is outputted from the output terminal (out) of the light emitting element driving unit 109 and inputted to the gate electrode of the current controlling TFT 107.

Table 1 shows the relation between a signal inputted to one of the input terminals (in1 to in4) of the light emitting element driving unit 109 and the ratio of a period in which a display signal is outputted from the output terminal (out) to one frame period (gradation).

TABLE 1

| In1 | In2 | In3 | In4 | Gradation |
|---|---|---|---|---|
| 1 | 1 | 1 | 1 | 0 |
| 0 | 1 | 1 | 1 | 1/16 |
| 1 | 0 | 1 | 1 | 2/16 |
| 0 | 0 | 1 | 1 | 3/16 |

TABLE 1-continued

| In1 | In2 | In3 | In4 | Gradation |
|---|---|---|---|---|
| 1 | 1 | 0 | 1 | 4/16 |
| 0 | 1 | 0 | 1 | 5/16 |
| 1 | 0 | 0 | 1 | 6/16 |
| 0 | 0 | 0 | 1 | 7/16 |
| 1 | 1 | 1 | 0 | 8/16 |
| 0 | 1 | 1 | 0 | 9/16 |
| 1 | 0 | 1 | 0 | 10/16+11 |
| 0 | 0 | 1 | 0 | 11/16+11 |
| 1 | 1 | 0 | 0 | 12/16+11 |
| 0 | 1 | 0 | 0 | 13/16+11 |
| 1 | 0 | 0 | 0 | 14/16+11 |
| 0 | 0 | 0 | 0 | 15/16+11 |

In the present invention, the light emitting element driving unit 109 can have any logic circuit as long as the circuit operates as shown in Table 1.

Instead, the circuit used may operate as shown in Table 2, which is reverse to Table 1.

TABLE 2

| In1 | In2 | In3 | In4 | Gradation |
|---|---|---|---|---|
| 1 | 1 | 1 | 1 | 15/16+11 |
| 0 | 1 | 1 | 1 | 14/16+11 |
| 1 | 0 | 1 | 1 | 13/16+11 |
| 0 | 0 | 1 | 1 | 12/16+11 |
| 1 | 1 | 0 | 1 | 11/16+11 |
| 0 | 1 | 0 | 1 | 10/16+11 |
| 1 | 0 | 0 | 1 | 9/16 |
| 0 | 0 | 0 | 1 | 8/16 |
| 1 | 1 | 1 | 0 | 7/16 |
| 0 | 1 | 1 | 0 | 6/16 |
| 1 | 0 | 1 | 0 | 5/16 |
| 0 | 0 | 1 | 0 | 4/16 |
| 1 | 1 | 0 | 0 | 3/16 |
| 0 | 1 | 0 | 0 | 2/16 |
| 1 | 0 | 0 | 0 | 1/16 |
| 0 | 0 | 0 | 0 | 0 |

When the display signal is inputted to the gate electrode of the current controlling TFT 107, the current controlling TFT 107 is turned ON to give the power supply electric potential of the power supply line Vi the pixel electrode of the light emitting element 108. There is an electric potential difference (voltage) between the opposite electric potential and the power supply electric potential of the opposite electrode. When the power supply electric potential is given to the pixel electrode, the electric potential difference (voltage) is applied to an organic compound layer of the light emitting element 108. In this specification, the electric potential difference between the pixel electrode and the opposite electrode at this point is called a light emitting element drive voltage. The light emitting element drive voltage is high enough to cause the light emitting element to emit light when the light emitting element drive voltage is applied to the organic compound layer. The light emitting element 108 emits light when the light emitting element drive voltage is applied to the organic compound layer.

After the light emission period Ts is ended, the non-light emission period Tb is started. As the non-light emission period Tb is started, the display signal is no longer inputted to the current controlling TFT 107 from the light emitting element driving unit 109 and, instead, a non-display signal is inputted from the light emitting element driving unit 109 to the gate electrode of the current controlling TFT 107. When the non-display signal is inputted to the gate electrode of the current controlling TFT 107, the current controlling TFT 107 is turned OFF. Accordingly, the power supply electric potential is not given to the pixel electrode of the light emitting element 108 and the light emitting element 108 is in the non-luminous state (stops emitting light).

As the non-light emission period Tb is ended, one frame period is completed and the writing period Ta of the next one frame period is started to repeat the same operation.

Illustrated in FIG. 2 is the case in which one frame period has both the light emission period Ts and the non-light emission period Tb. However, the present invention is not limited thereto. Depending on the gradation of the pixel, the non-light emission period Tb may come after the writing period Ta is ended instead of the light emission period Ts. On the other hand, the writing period of the next one frame period may come after the light emission period Ts instead of the non-light emission period Tb.

In the light emitting device of the present invention, the gradation of a pixel in a specific frame period is determined by the ratio of lengths of the light emission period Ts and the non-light emission period Tb. As the ratio of length of the light emission period Ts in one frame period is larger, the pixel has a gradation for brighter display. As the ratio of length of the light emission period Ts is smaller, on the other hand, the pixel has a gradation for darker display.

Although the writing period Ta, the light emission period Ts, and the non-light emission period Tb are separated from one another in this embodiment mode, the writing period Ta, the light emission period Ts or the non-light emission period Tb may overlap with one another. In other words, digital video signals having image information of the next frame period may be written in the first memories while the light emitting element emits light.

In the light emitting device of the present invention, light emitting elements of plural pixels in the state (non-luminous state) where they do not emit light simultaneously become the luminous state (emit light) only when a writing period is ended to start a light emission period. Accordingly, lowering of luminance of light emitting elements while the light emitting elements emit light is restrained as much as possible.

Also, animation pseudocontour can be avoided because a light emitting element does not emit light in consecutive periods of consecutive frame periods when an intermediate gradation is to be obtained.

Embodiments of the present invention will be described below.

Embodiment 1

This embodiment describes a case in which the light emitting element driving unit 109 of the pixel shown in FIG. 1 has a counter circuit. The description is given with reference to FIG. 3. Although the embodiment deals with the structure of the pixel in the light emitting device for 4 bit digital video signals, the light emitting device of the present invention is not limited to 4 bit digital video signals.

Figure 3:
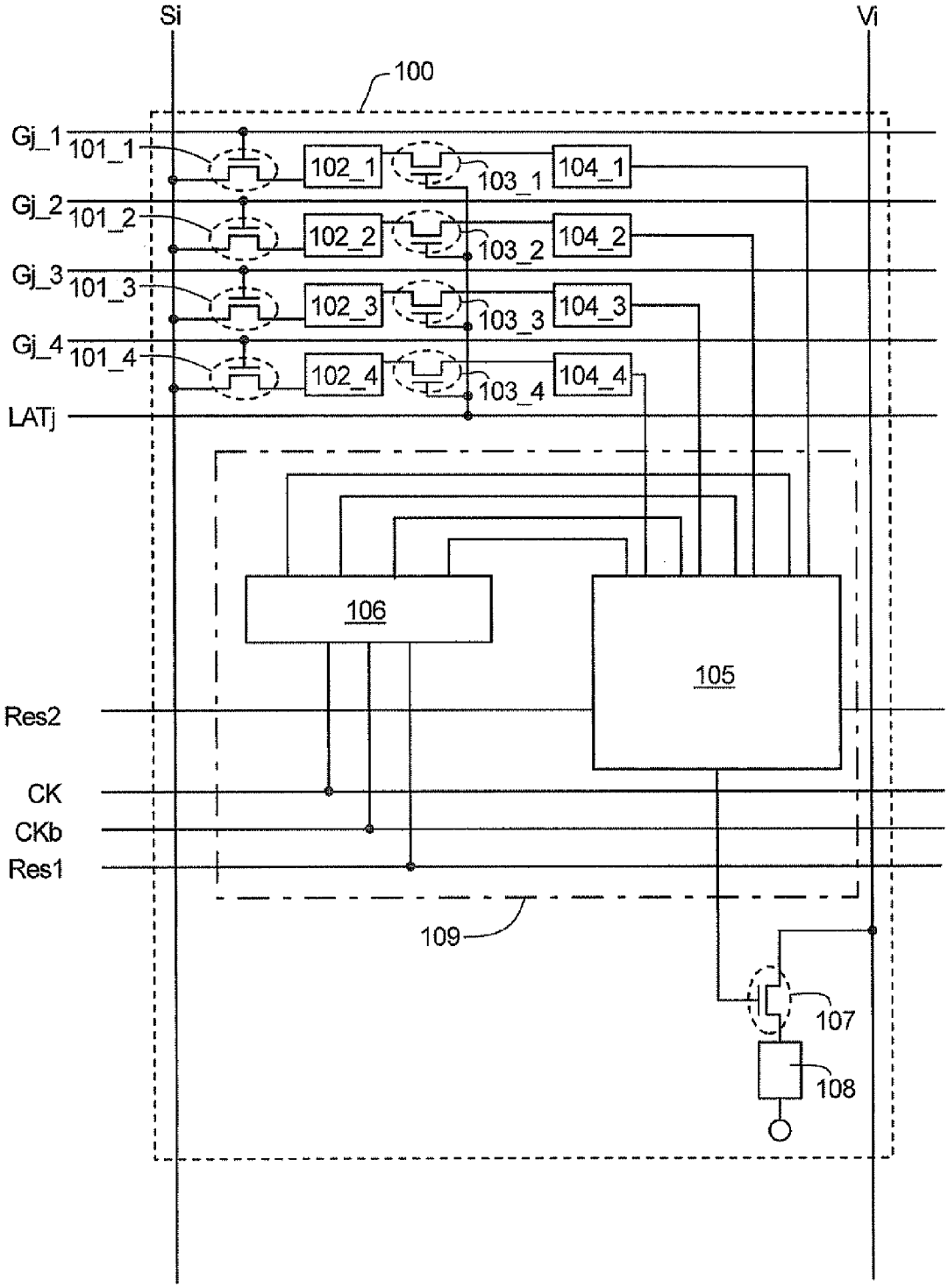
FIG. 3 is a circuit diagram of a pixel in a light emitting device of Embodiment 1.

FIG. 3 shows the structure of the pixel of the light emitting device according to this embodiment. Components already shown in FIG. 1 are denoted by the same symbols. In this embodiment, the light emitting element driving unit 109 has a display signal generating unit 105 and a counter circuit 106.

The input terminals of the light emitting element driving unit 109 shown in Embodiment Mode correspond to first input terminals of the display signal generating unit 105 in this embodiment. The number of the first input terminals provided in the display signal generating unit 105 is the same as the bit number of the digital video signals (4, in this embodiment). The four first input terminals of the display signal generating unit 105 are connected to the output terminals of the second memories 104_1 to 104_4 on one on one basis.

The output terminal of the light emitting element driving unit 109 shown in Embodiment Mode corresponds to an output terminal of the display signal generating unit 105 in this embodiment. The output terminal of the display signal generating unit 105 is connected to the gate electrode of the current controlling TFT 107.

The counter circuit 106 is provided with output terminals, the number of which is the same as the bit number of the digital video signals (4, in this embodiment). The display signal generating unit 105 has second input terminals, the number of which is the same as the bit number of the digital video signals (4, in this embodiment). The output terminals of the counter circuit 106 are connected to the second input terminals of the display signal generating unit 105 on one on one basis.

In this embodiment, digital video signals held in the second memories 104_1 to 104_4 are inputted to the first input terminals of the display signal generating unit 105.

The counter circuit 106 is inputted with a clock signal CK, a signal CKb obtained by inverting the polarity of the clock signal, and a first reset signal Res1. The counter circuit 106 counts how many cycles (periods) of CK or CKb are inputted since reset by Res1. A signal having as its information the counted number of cycles (periods) of CK or CKb (counter signal) is inputted to the second input terminals of the display signal generating unit 105 from the counter circuit 106.

A counter signal is outputted from each of the second input terminals the number of which is the same as the bit number of the digital video signals (4, in this embodiment). If a light emitting device is for n bit digital video signals, a counter signal is called herein a first, second, . . . , or n-th counter signal depending on from which terminal of n second input terminals the signal is outputted. All of the first through n-th counter signals are generally called as counter signals. This embodiment has first to fourth counter signals.

A second reset signal Res2 that is in synchronism with the first reset signal Res1 is inputted to the display signal generating unit 105. The light emission period Ts is started in response to the second reset signal Res2 and a display signal is outputted from the output terminal of the display signal generating unit 105. The display signal is inputted to the gate electrode of the current controlling TFT 107 to turn the current controlling TFT 107 ON and supply the pixel electrode of the light emitting element 108 with the power supply electric potential. The light emitting element 108 thus emits light (luminous state).

The display signal generating unit 105 compares 4 bit digital video signals inputted through the first input terminals with counter signals inputted through the second input terminals. When the digital video signals match the counter signals, the light emission period Ts is ended and a non-display signal is outputted instead of the display signal from the output terminal of the display signal generating unit 105 to start the non-light emission period Tb.

The non-display signal is inputted to the gate electrode of the current controlling TFT 107 to turn the current controlling TFT 107 OFF. Then the power supply electric potential is no longer given to the pixel electrode of the light emitting element 108 and the light emitting element 108 stops emitting light (non-luminous state).

As the non-light emission period Tb is ended, one frame period is completed and the writing period Ta of the next one frame period is started to repeat the same operation.

The display signal generating unit 105 in this embodiment can have any logic circuit as long as it outputs a display signal in response to Res2 and outputs a non-display signal instead of the display signal when digital video signals that are inputted to the first input terminals match counter signals that are inputted to the second input terminals.

The first reset signal Res1 and the second reset signal Res2 may be the same signal outputted from the same signal source.

The counter circuit provided in each pixel of the light emitting device of the present invention may have any structure as long as it conducts addition or subtraction upon receiving input signals (CK, CKb, Res1) and counts the input signals.

Embodiment 2

This embodiment describes a specific structure of the display signal generating unit 105 of the pixel shown in FIG. 3. The description is given referring to FIG. 4. Although the embodiment deals with the structure of the pixel in the light emitting device for 4 bit digital video signals, the light emitting device of the present invention is not limited to 4 bit digital video signals.

Figure 4:
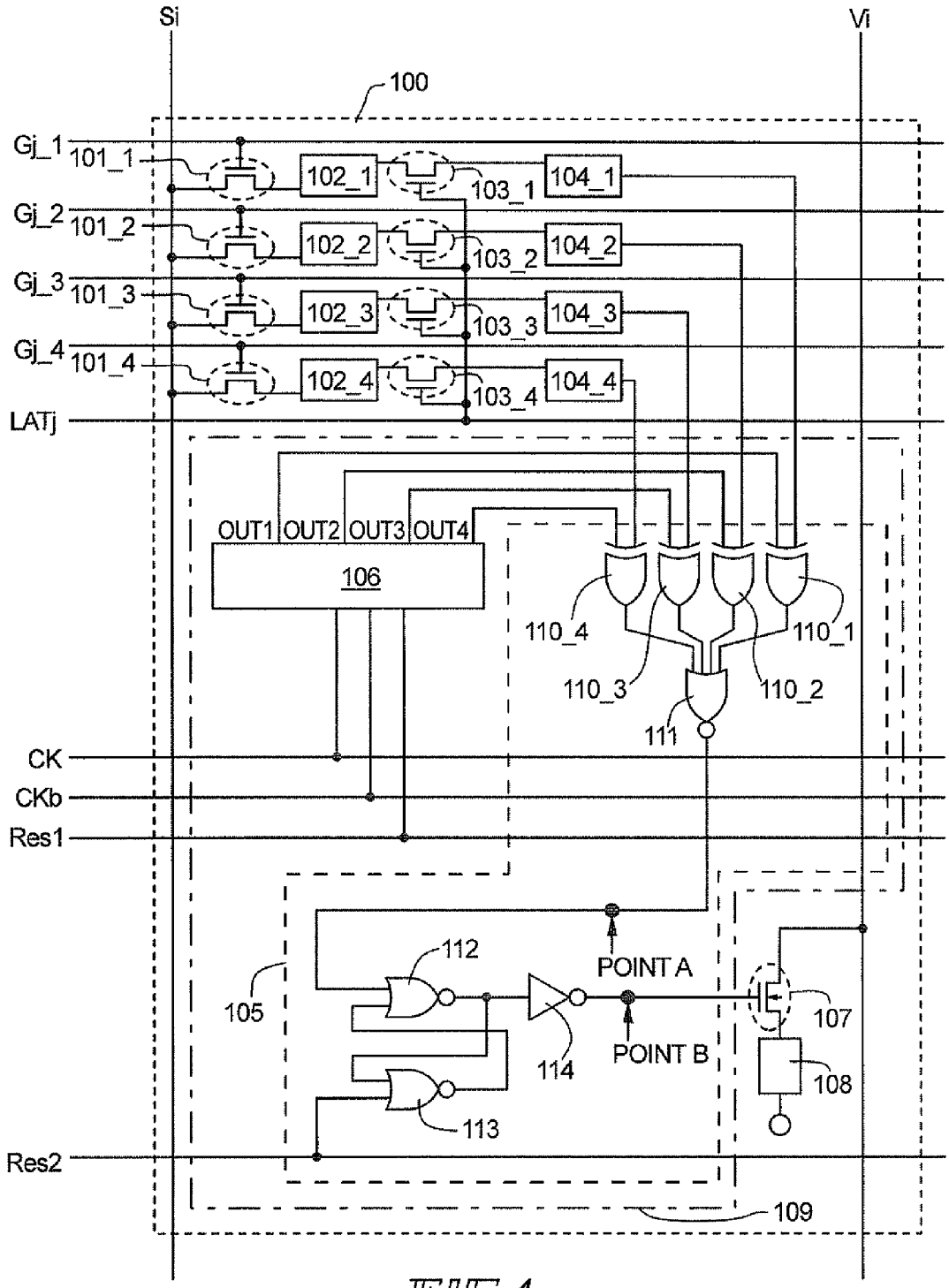
FIG. 4 is a circuit diagram of a pixel in a light emitting device of Embodiment 2.

FIG. 4 shows the structure of the pixel of the light emitting device according to this embodiment. Components already shown in FIG. 3 are denoted by the same symbols. To simplify the explanation, the output terminals (four in total in this embodiment) of the counter circuit 106 are called out1 to out4 in this embodiment. The first to fourth counter signals are outputted from the output terminals out1 to out4, respectively.

The display signal generating unit 105 of this embodiment specifically has exclusive ORs (exORs) 110_1 to 110_4, NORs 111, 112, and 113 and an inverter 114. The number of exORs is the same as the bit number of the digital video signal (4, in this embodiment).

The four exORs 110_1 to 110_4 each have two input terminals. One is the first input terminal and the other is the second input terminal. Output terminals of the four exORs 110_1 to 110_4 are connected to four input terminals of the NOR 111.

An output terminal of the NOR 111 is connected to one of two input terminals of the NOR 112. Of the two input terminals of the NOR 112, the one that is not connected to the output terminal of the NOR 111 is connected to an output terminal of the NOR 113. The NOR 113 has two input terminals one of which is connected to an output terminal of the NOR 112 and the other of which is inputted with the second reset signal Res2. The output terminal of the NOR 112 is connected to an input terminal of the inverter 114. An output terminal of the inverter 114 is connected to the gate electrode of the current controlling TFT 107.

The operation of the display signal generating unit 105 is described below.

The first to fourth sets of one bit digital video signals of 4 bit digital video signals are outputted from the output terminals of the second memories 104_1 to 104_4, respectively, and are respectively inputted to the four first input terminals of the display signal generating unit 105. The first to fourth counter signals, are outputted from the output terminals out1 to out4 of the counter circuit 106, respectively, and are respectively inputted to the four second input terminals of the display signal generating unit 105.

The display signal generating unit 105 has a first function of comparing all the digital video signals inputted through the first input terminals with all the counter signals inputted through the second input terminals to judge whether or not the signals match to each other. In the display signal generating unit 105 of this embodiment, the first function is carried out by the four exORs 110_1 to 110_4 and the NOR 111.

The second reset signal Res2 that is in synchronism with the first reset signal Res1 is inputted to the display signal generating unit 105. The display signal generating unit 105 starts inputting a display signal to the gate electrode of the current controlling TFT 107 in response to the second reset signal Res2 at the same time the first reset signal Res1 resets the counter circuit 106 and, when the first function judges that the digital video signal matches the counter signal, inputs a non-display signal instead of the display signal to the gate electrode of the current controlling TFT 107 to turn the current controlling TFT 107 OFF. This is called a second function. The second function is carried out by the two NORs 112 and 113 in the display signal generating unit 105 of this embodiment.

The inverter 114 has a function of inverting the polarity of a display signal a non-display signal outputted from the output terminal of the NOR 112 such that a display signal outputted from the output terminal of the NOR 112 turns the current controlling TFT 107 ON and a non-display signal outputted from the output terminal of the NOR 112 turns the current controlling TFT 107 OFF. Depending on the polarity of the current controlling TFT 107, the inverter 114 is not always necessary. Described in this embodiment is a case in which the current controlling TFT 107 is an n-channel TFT. Accordingly this embodiment needs the inverter 114 in order to turn the current controlling TFT 107 ON when a display signal is outputted from the output terminal of the NOR 112 and to turn the current controlling TFT 107 OFF when a non-display signal is outputted from the output terminal of the NOR 112. If the current controlling TFT 107 is a p-channel TFT, on the other hand, the inverter 114 is not necessary.

Figure 5:
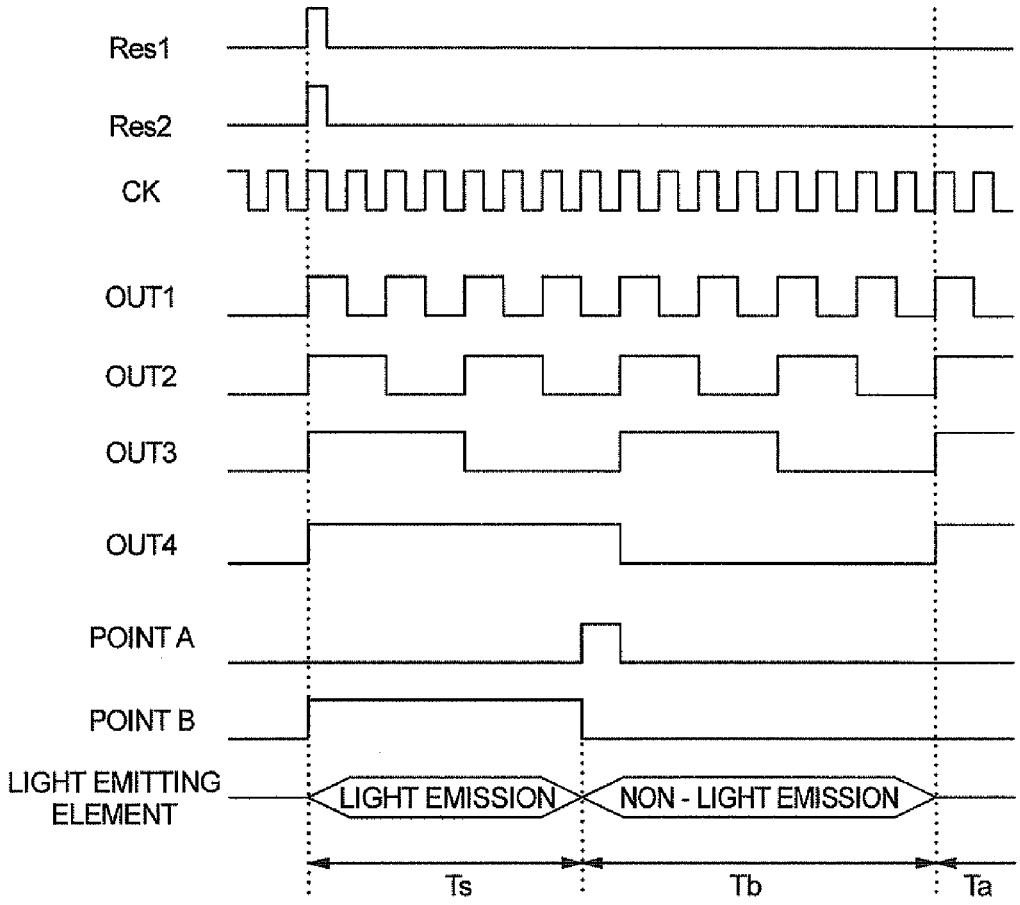
FIG. 5 is a timing chart according to a driving method of Embodiment 2.

As has been described in Embodiment Mode, the counter circuit 106 is inputted with a clock signal CK, a signal CKb obtained by inverting the polarity of the clock signal, and a first reset signal Res1. As the first reset signal Res1 resets the counter circuit, the counter circuit 106 starts outputting from its output terminal a counter signal that has a frequency different from the frequency of the clock signal CK. FIG. 5 shows a timing chart of the first reset signal Res1, the check signal CK, and the first to fourth counter signals outputted from the output terminals out1 to out4.

The first to fourth counter signals outputted from the four output terminals out1 to out4, respectively, have frequencies different from one another. For instance, outputted from an m-th output terminal outm (m is an arbitrary natural number ranging from 1 to 4) is an m-th counter signal that has a frequency obtained by dividing the frequency of the clock signal CK by $2^m$.

In a light emitting device for n (n is a natural number) bit digital video signals, an m-th (m is a natural number ranging from 1 to n) output terminal outm outputs a signal that has a frequency obtained by dividing the frequency of the clock signal CK by $2^m$.

Based on the polarity of counter signals outputted from all the output terminals (out1 to out4, in this embodiment), how many cycles (periods) of CK or CKb are inputted to the counter circuit 106 since reset by Res1 are counted.

The NOR 111 outputs from its output terminal a '1' (Hi) signal when counter signals inputted to the exORs 110_1 to 110_4 match digital signals inputted to the exORs 110_1 to 110_4, and a '0' (Lo) signal when the signals do not match to each other. FIG. 5 shows the electric potential at Point A when Lo digital video signals are inputted to the exORs 110_1 to 110_3 and a Hi digital video signal is inputted to the exOR 110_4 (110_1, 110_2, 110_3, 110_4; Lo, Lo, Lo, Hi).

Synchronizing reset of the counter circuit 106 by Res1, Res2 inputted to the input terminal of the NOR 113 is changed from '1' (Hi) to '0' (Lo). Since the output of the NOR 111 is '0' (Lo) when the counter signals do not match the digital video signals, the electric potential at Point B is Hi and the current controlling TFT 107 that is an n-channel TFT is turned ON. Then the light emitting element 108 starts emitting light (luminous state).

On the other hand, the output of the NOR 111 is '1' (Hi) when the counter signals match the digital video signals and the electric potential at Point B is Lo to turn the current controlling TFT 107 that is an n-channel TFT OFF. Then the light emitting element 108 stops emitting light (non-luminous state).

A period in which the light emitting element 108 emits light is the light emission period Ts. Therefore the light emission period of a specific pixel corresponds to a period starting as Res1 resets the counter circuit 106 and Res2 is changed to '1' (Hi) and ending immediately before the counter signals and the digital video signals that are inputted to the display signal generating unit 105 match to each other. The non-light emission period Tb of that pixel corresponds to a period starting as the counter signals and the digital video signals that are inputted to the display signal generating unit 105 match to each other and ending before the writing period Ta of the next frame period is started.

In the light emitting device of the present invention, the ratio of the display period and the non-display period determines the gradation of a pixel in a specific frame period. The length of the display period depends on information contained in digital video signals.

Although positive logic is used in this embodiment, negative logic may be employed instead.

In the light emitting device of the present invention, light emitting elements of plural pixels simultaneously become from the non-luminous state to the luminous state (emit light) only when a writing period is ended to start a light emission period. Accordingly, light emitting elements of plural pixels simultaneously become from the non-luminous state to the luminous state(start emitting light) not more than once in a frame period whichever gradation is to be obtained. The number of times the luminance of light emitting elements is temporarily lowered, which is caused by light emitting elements of plural pixels simultaneously becoming from the non-luminous state to the luminous state (starting light emission), is thus controlled and flickers on the screen can be reduced.

Also, animation pseudocontour can be avoided because a light emitting element does not emit light in consecutive periods of consecutive frame periods when an intermediate gradation is to be obtained.

Embodiment 3

Figure 6A:
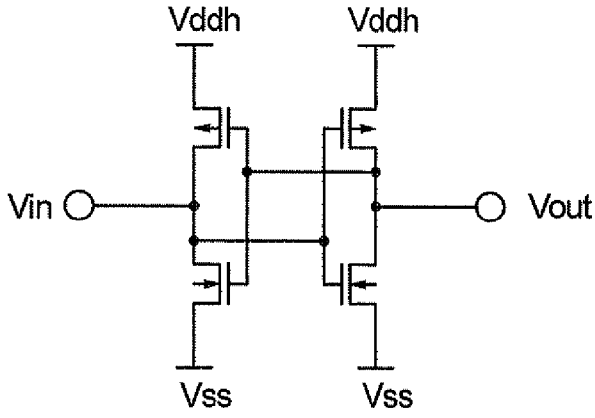
FIGS. 6A to 6C are equivalent circuit diagrams of a first memory or a second memory of Embodiment 3.
Figure 6B:
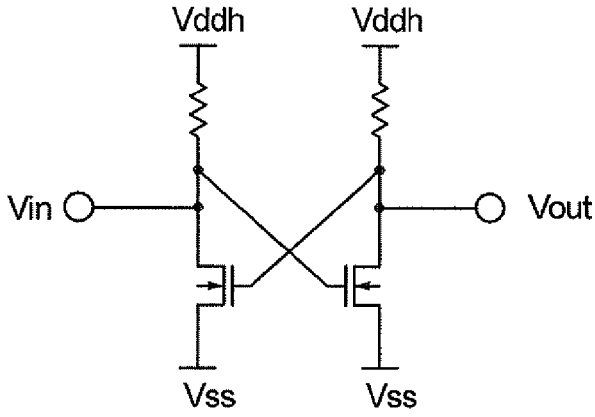
Figure 6C:
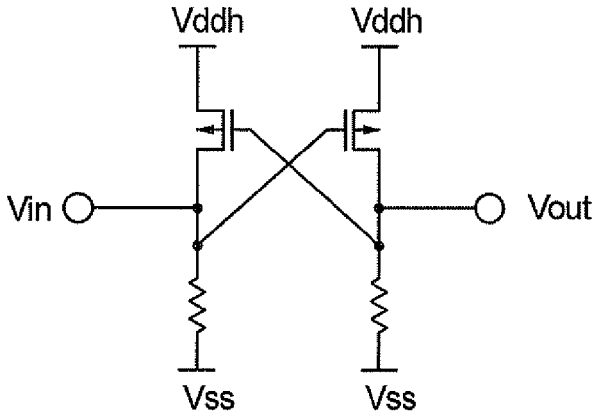

This embodiment describes the structure of a first memory and a second memory provided in a pixel of a light emitting device of the present invention. In this embodiment, SRAMs are used for the first memory and the second memory. FIGS. 6A to 6C show equivalent circuit diagrams of SRAMs used in this embodiment.

The SRAM shown in FIG. 6A has two p-channel TFTs and two n-channel TFTs. Source regions of the p-channel TFTs are each connected to a high voltage side power supply, Vddh, whereas source regions of the n-channel TFTs are each connected to a low voltage side power supply, Vss. One p-channel TFT and one n-channel TFT make a pair and therefore one SRAM has two pairs of p-channel TFTs and n-channel TFTs.

The p-channel TFT and the n-channel TFT of a pair are connected to each other through their drain regions. The p-channel TFT and the n-channel TFT of a pair are connected to each other through their gate electrodes. The drain regions of the p-channel TFT and the n-channel TFT of one pair are kept at the same level of electric potential as the gate electrodes of the p-channel TFT and the n-channel TFT of the other pair. The drain regions of the p-channel TFT and the n-channel TFT of one pair serve as input terminals and is provided with an input signal (Vin). The drain regions of the p-channel TFT and the n-channel TFT of the other pair serve as output terminals and an output signal (Vout) is outputted therefrom.

The SRAM is designed to hold Vin and to output Vout that is a signal obtained by inverting Vin. In other words, when Vin is Hi, Vout is a Lo signal corresponding to Vss and, when Vin is Lo, Vout is a Hi signal corresponding to Vddh.

The SRAM shown in FIG. 6B has two n-channel TFTs and two resistors. One n-channel TFT and one resistor make a pair and therefore one SRAM has two pairs of n-channel TFTs and resistors. Drain regions of the n-channel TFTs are each connected to a high voltage side power supply, Yddh, whereas source regions of the n-channel TFTs are each connected to a low voltage side power supply, Vss, through the resistors.

The drain region of the n-channel TFT of one pair is kept at the same level of electric potential as the gate electrode of the n-channel TFT of the other pair. The drain region of the n-channel TFT of one pair serves as an input terminal and is provided with an input signal (Vin). The drain region of the n-channel TFT of the other pair serves as an output terminal and an output signal (Vout) is outputted therefrom.

The SRAM is designed to hold Vin and to output Vout that is a signal obtained by inverting Vin. In other words, when Vin is Hi, Vout is a Lo signal corresponding to Vss and, when Vin is Lo, Vout is a Hi signal corresponding to Vddh.

In the SRAM shown in FIG. 6B, the resistors can be formed at the same time the n-channel TFTs are formed. Therefore the SRAM of FIG. 6B does not need a p-channel TFT and require fewer steps in manufacture as compared to the SRAM shown in FIG. 6A.

The SRAM shown in FIG. 6C has two p-channel TFTs and two resistors. One p-channel TFT and one resistor make a pair and therefore one SRAM has two pairs of p-channel TFTs and resistors. Source regions of the p-channel TFTs are each connected to a high voltage side power supply, Vddh, whereas drain regions of the p-channel TFTs are each connected to a low voltage side power supply, Vss, through the resistors.

The drain region of the p-channel TFT of one pair is kept at the same level of electric potential as the gate electrode of the p-channel TFT of the other pair. The drain region of the p-channel TFT of one pair serves as an input terminal and is provided with an input signal (Vin). The drain region of the p-channel TFT of the other pair serves as an output terminal and an output signal (Vout) is outputted therefrom.

The SRAM is designed to hold Vin and to output Vout that is a signal obtained by inverting Vin. In other words, when Vin is Hi, Vout is a Lo signal corresponding to Vss and, when Vin is Lo, Vout is a Hi signal corresponding to Vddh.

In the SRAM shown in FIG. 6C, the resistors can be formed at the same time the n-channel TFTs are formed. Therefore the SRAM of FIG. 6C does not need a n-channel TFT and require fewer steps in manufacture as compared to the SRAM shown in FIG. 6A.

The first memory and the second memory in the pixel of the light emitting device of the present invention are not limited to the structures shown in this embodiment. Any logic circuit can be used for the first memory and the second memory in the pixel of the light emitting device of the present invention as long as it can temporarily store inputted signals.

This embodiment may be combined freely with the structure of Embodiment 1 or 2.

Embodiment 4

This embodiment describes the structure of a counter circuit of a pixel in a light emitting device of the present invention.

Figure 7:
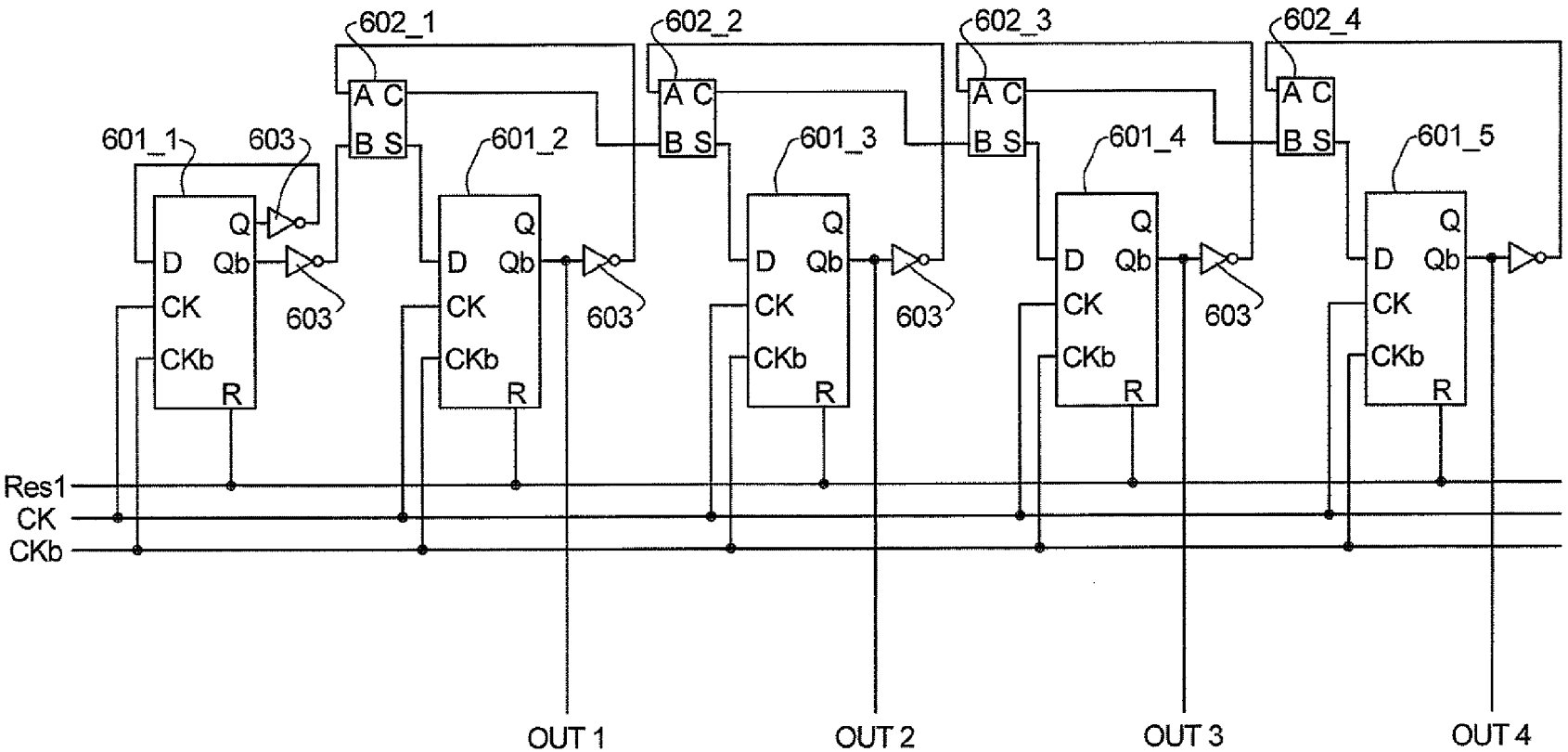
FIG. 7 is a circuit diagram of a counter circuit of Embodiment 4.

FIG. 7 is a circuit diagram of a counter circuit according to this embodiment. The description given in this embodiment is about a counter circuit of a pixel provided in a light emitting device for 4 bit digital video signals.

The counter circuit shown in FIG. 7 has five flip-flop circuits 601_1 to 601_5, four half adder circuits 602_1 to 602_4, and an inverter 603. The counter circuit has five flip-flop circuits and four half adder circuits because this embodiment describes a light emitting device for 4 bit digital video signals. When the light emitting device is for n bit digital video signals, the counter circuit has (n+1) flip-flop circuits and n half adder circuits. The number of inverter 603 is not limited to the number of inverter in the counter circuit shown in FIG. 7.

The counter circuit is provided with a clock signal CK, a signal CKb obtained by inverting the polarity of the clock signal, and a first reset signal Res1 from wiring lines shown in FIG. 7. Output terminals of the counter circuit are denoted by out1 to out4.

Figure 8A:
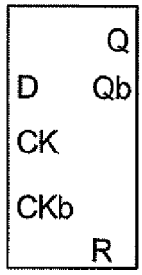
FIGS. 8A to 8C show logical symbols and equivalent circuit diagrams of a flip-flop circuit of Embodiment 4.
Figure 8B:
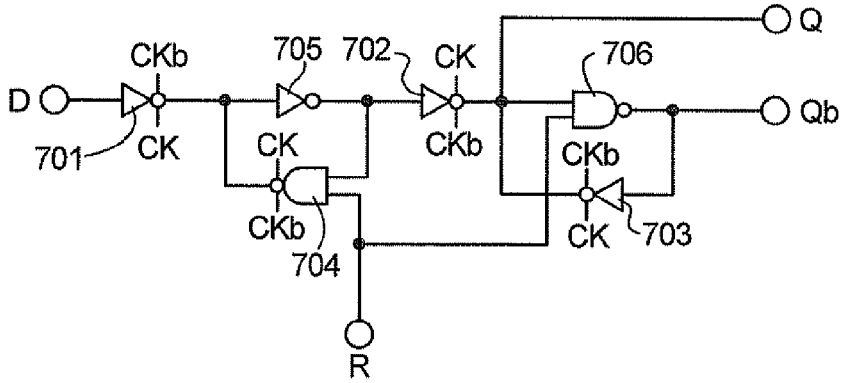
Figure 8C:
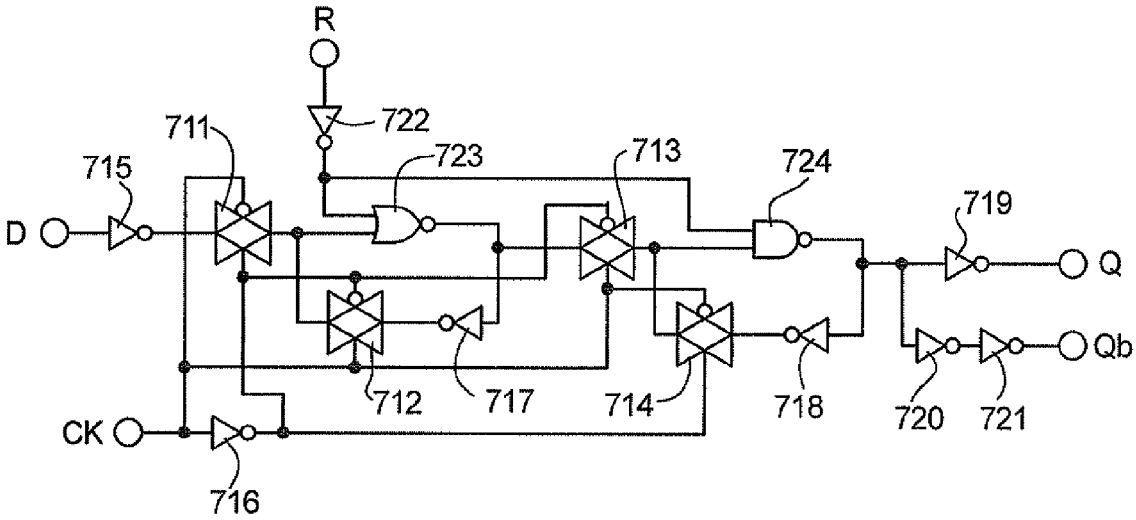

The structure of the flip-flop circuits 601_1 to 601_5 is described with reference to FIGS. 8A to 8C. FIG. 8A shows logical symbols of the flip-flop circuits 601_1 to 601_5 of FIG. 7. The flip-flop circuit shown in FIG. 8A is a delay flip-flop circuit with reset (hereinafter referred to as RD FF). FIGS. 8B and 8C are detailed circuit diagrams of RD FFs expressed by the logical symbols shown in FIG. 8A.

The RD FF shown in FIG. 8B has clocked inverters 701 to 704, an inverter 705, and a NAND 706. CK and CKb are inputted to the clocked inverters 701 to 704.

The RD FF shown in FIG. 8C has analog switches 711 to 714, inverters 715 to 722, a NOR 723, and a NAND 724.

The flip-flop circuits used in this embodiment are not limited to the structures shown in FIGS. 8A to 8C. The flip-flop circuits used in this embodiment can have any structure as long as it makes an RD FF.

Figure 9A:
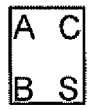
FIGS. 9A to 9D show logical symbols and equivalent circuit diagrams of a half adder circuit of Embodiment 4.

The structure of the half adder circuits 602_1 to 602_4 is described next with reference to FIGS. 9A to 9D. FIG. 9A shows logical symbols of the half adder circuits 602_1 to 602_4 of FIG. 7. In the half adder circuit shown in FIG. 9A, signals inputted to input terminals A and B determine signals outputted from output terminals C and S. Table 3 shows the operational function of the half adder circuits 602_1 to 602_4.

TABLE 3

| A | B | C | S |
|---|---|---|---|
| 1 | 1 | 1 | 0 |
| 1 | 0 | 0 | 1 |
| 0 | 1 | 0 | 1 |
| 0 | 0 | 0 | 0 |

Figure 9B:
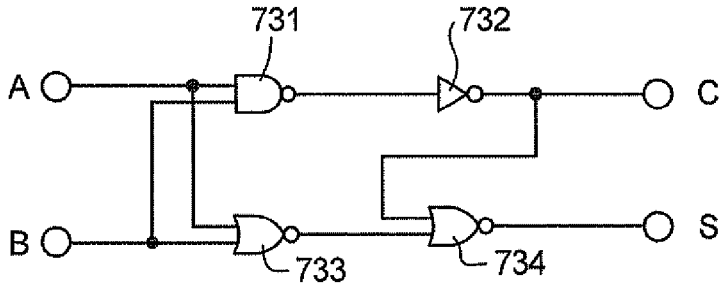
Figure 9C:
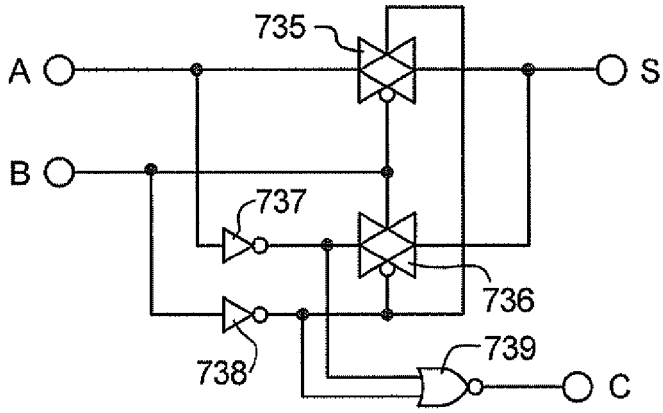
Figure 9D:
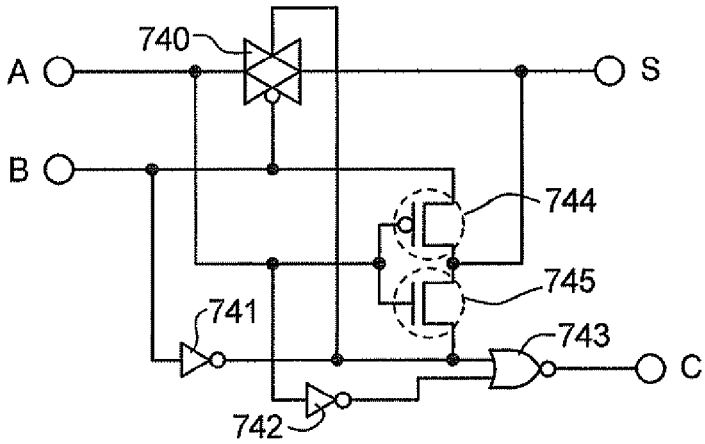

FIGS. 9B, 9C and 9D are detailed circuit diagrams of half adder circuits expressed by the logical symbols shown in FIG. 9A.

The half adder circuit shown in FIG. 9B has a NAND 731, an inverter 732, and NORs 733 and 734.

The half adder circuit shown in FIG. 9C has analog switches 735 and 736, inverters 737 and 738, and a NOR 739.

The half adder circuit shown in FIG. 9D has an analog switch 740, inverters 741 and 742, a NOR 743, a p-channel TFT 744, and an n-channel TFT 745.

The half adder circuits used in this embodiment are not limited to the structures shown in FIGS. 9A to 9D. The half adder circuits used in this embodiment can have any structure as long as it has the operational function shown in Table 3.

The counter circuit provided in the pixel of the light emitting device of the present invention is not limited to the structures shown in this embodiment. The counter circuit can have any structure as long as it conducts addition or subtraction upon receiving input signals and counts the input signals.

This embodiment may be combined freely with the structures of Embodiments 1 through 3.

Embodiment 5

In the light emitting device of the present invention, a digital video signal to be inputted to the source signal line are outputted from the source signal driving circuit. The selective signal to be inputted to the gate signal line is outputted from the gate signal driving circuit. In this embodiment, the structure of the source signal driving circuit and the gate signal line driver circuit used in the present invention are explained.

Figure 10A:
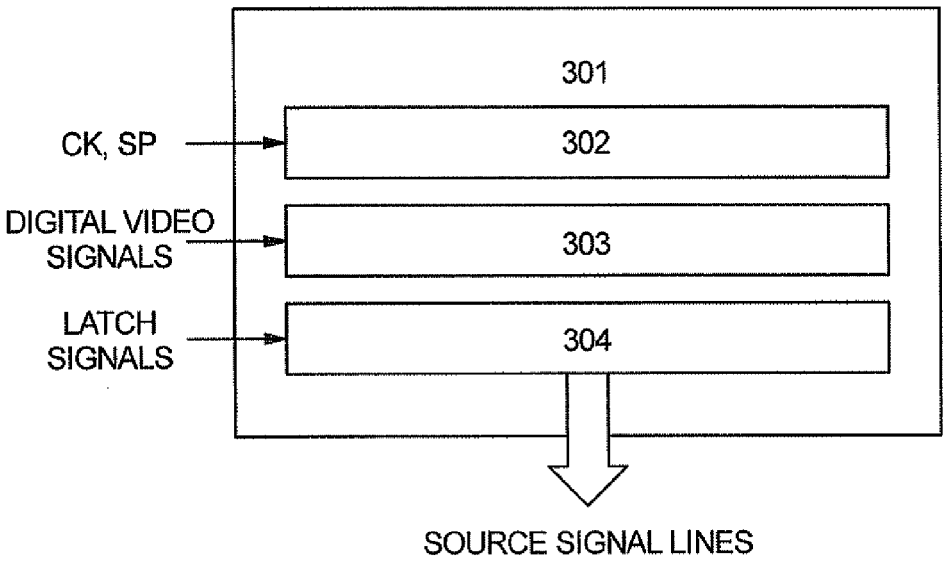
FIGS. 10A and 10B are block diagrams showing a source signal line driving circuit and a gate signal line driving circuit, respectively, of Embodiment 5.
Figure 10B:
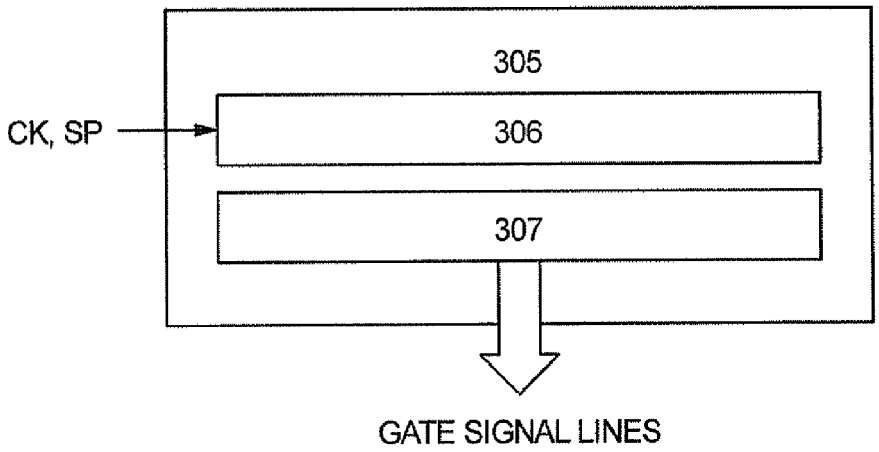

The block figure of a source signal driving circuit 301 of this embodiment is shown in FIG. 10A. The source signal driving circuit 301, which has a shift register 302, a latch (A) 303, and a latch (B) 304.

A clock signal CLK and a start pulse SP are inputted to the shift register 302 in the source signal driving circuit 301. The shift register 302 generates timing signals in order based upon the clock signal CLK and the start pulse SP, and supplies the timing signals one after another to the subsequent stage circuit through the buffer (not illustrated) and the like.

Note that, although not shown in the figure, the timing signals output from the shift register 302 may be buffer amplified by a buffer and the like. The load capacitance (parasitic capacitance) of a wiring to which the timing signals are supplied is large because many of the circuits or elements are connected to the wiring. The buffer is formed in order to prevent bluntness in the rise and fall of the timing signal, generated due to the large load capacitance. In addition, the buffer is not always necessary provided, The timing signal amplified by a buffer is inputted to the latch (A) 303. The latch (A) 303 has a plurality of latch stages for processing n-bit digital video signals. The latch (A) 303 takes in and maintains the n-bit digital video signals inputted from external of the source signal driving circuit 301, when the timing signal is input.

Note that the digital video signals may also be input in order to the plurality of latch stages of the latch (A) 303 in writing in the digital video signal to the latch (A) 303. However, the present invention is not limited to this structure. The plurality of latch stages of the latch (A) 303 may be divided into a certain number of groups, and the digital video signal may be input to the respective groups at the same time in parallel, performing division driving. For example, when the latches are divided into groups every four stages, it is referred to as division driving with 4 divisions.

The period during which the digital video signal is completely written into all of the latch stages of the latch (A) 303 is referred to as a line period. In practice, there are cases in which the line period includes the addition of a horizontal return period to the above line period.

One line period is completed, the latch signal is inputted to the latch (B) 304. At the moment, the digital video signals written into and stored in the latch (A) 303 are send all together to be written into and stored in the all stage of the latch (B) 304.

In the latch (A) 303 after completing sending the digital video signals to the latch (B) 304, it is performed to write into the digital video signals in accordance with the timing signal from the shift resister 302.

In the latch (A) 303 after completing sending the digital video signals to the latch (B) 304, it is performed to write into the digital video signals in accordance with the timing signal from the shift register 302.

The gate signal driving circuit 305 has the shift register 306 and the buffer 307. According to circumstances, the level shift is provided.

In the gate signal driving circuit 305, the timing signal from the shift register 306 is inputted to the buffer 307, and then to a corresponding gate signal line. The gate electrodes of the first switching TFTs for one line of pixels are connected to the gate signal lines, and all of the first switching TFTs of the one line of pixels must be placed in an ON state simultaneously. A circuit, which is capable of handling the flow of a large electric current, is therefore used for the buffer.

Further, the source signal driving circuit and the gate signal driving circuit of the light emitting device of the present invention are not limited its structure shown in this embodiment. The number of the source signal driving circuit and the gate signal driving circuit are not necessarily limited to one each of them. The plurality of either source signal driving circuit or gate signal driving circuit may be formed to display an image in one pixel.

In addition, the source signal driving circuit and the gate signal driving circuit may not be necessarily formed on the same substrate as that the pixel portion is formed on. These two circuits may be formed on the different substrate to connected through the connector like FPC and so forth.

Note that it is possible to implement Embodiment 5 in combination with Embodiments 1 to 4.

Embodiment 6

An example of manufacturing method of the light emitting device of the present invention is explained with the reference FIGS. 11A to 13B. Here, only the first switching TFT provided in the pixel portion of the light emitting device, the current control TFT and the n-channel TFT and the p-channel TFT of the first or second memory. Another TFT of the second switching TFT, the first memory and the second memory are possible to form in the same way.

This embodiment uses a substrate 900 of a glass such as barium borosilicate glass or aluminoborosilicate glass as represented by the glass #7059 or the glass #1737 of Corning Co. There is no limitation on the substrate 900 provided it has a property of transmitting light, and there may be used a quartz substrate. There may be further used a plastic substrate having heat resistance capable of withstanding the treatment temperature of this embodiment.

Figure 11A:
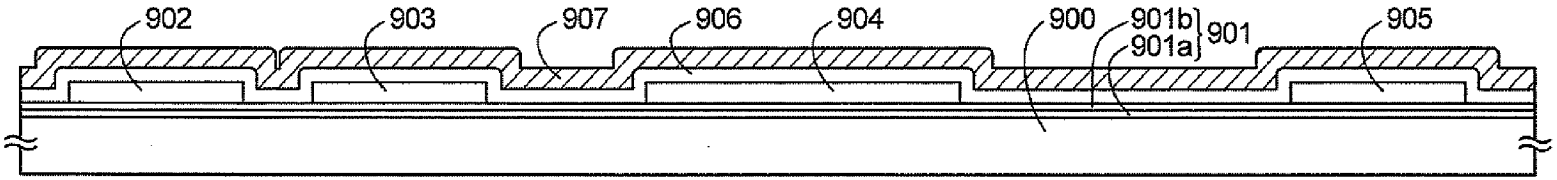
FIGS. 11A to 11D are diagrams showing a process of forming TFTs of Embodiment 6.

Referring next to FIG. 11A, an underlying film 901 comprising an insulating film such as silicon oxide film, silicon nitride film or silicon oxynitride film is formed on the substrate 900. In this embodiment, the underlying, film 901 has a two layered structure. There, however, may be employed a structure in which a single layer or two or more layers are laminated on the insulating film. The first layer of the underlying film 901 is a silicon oxynitride film 901*a* formed maintaining a thickness of from 10 to 200 nm (preferably from 50 to 100 nm) relying upon a plasma CVD method by using $SiH_4$, $NH_3$ and $N_2$0 as reaction gases. In this embodiment, the silicon oxynitride film 901*a* (having a composition ratio of Si=32%, O=27%, N=24%, H=17%) is formed maintaining a thickness of 50 nm. The second layer of the underlying, film 901 is a silicon oxynitride film 901*b* formed maintaining a thickness of from 50 to 200 nm (preferably, from 100 to 150 nm) relying upon the plasma CVD method by using $SiH_4$ and $N_2O$ as reaction gases. In this embodiment, the silicon oxynitride film 901*b* (having a composition ratio of Si=32%, O=59%, N=7%, H=2%) is formed maintaining a thickness of 100 nm.

Then, semiconductor layers 902 to 905 are formed on the underlying film 901. The semiconductor layers 902 to 905 are formed by forming a semiconductor film having an amorphous structure by a known means (sputtering method, LPCVD method or plasma CVD method) followed by a known crystallization processing (laser crystallization method, heat crystallization method or heat crystallization method using a catalyst such as nickel), and patterning the crystalline semiconductor film thus obtained into a desired shape, for example, island-like. The semiconductor layers 902 to 905 are formed in a thickness of from 25 to 80 nm (preferably, from 30 to 60 nm). Though there is no limitation on the material of the crystalline semiconductor film, there is preferably used silicon or a silicon-germanium ($Si_xGe_{1-x}$ (X=0.0001 to 0.02)) alloy. In this embodiment, the amorphous silicon film is formed maintaining a thickness of 55 nm relying on the plasma CVD method and, then, a solution containing nickel is held on the amorphous silicon film. The amorphous silicon film is dehydrogenated (500° C., one hour), heat crystallized (550° C., 4 hours) and is, further, subjected to the laser annealing to improve the crystallization, thereby to form a crystalline silicon film. The crystalline silicon film is patterned by the photolithographic method to form island-like semiconductor layers 902 to 905.

The semiconductor layers 902 to 905 that have been formed may further be doped with trace amounts of an impurity element (boron or phosphorus) to control the threshold value of the TFT.

In forming the crystalline semiconductor film by the laser crystallization method, further, there may be employed an excimer laser of the pulse oscillation type or of the continuously light emitting type, a YAG laser or a $YVO_4$ laser. When these lasers are to be used, it is desired that a laser beam emitted from a laser oscillator is focused into a line through an optical system so as to fall on the semiconductor film. The conditions for crystallization are suitably selected by a person who carries out the process. When the excimer laser is used, the pulse oscillation frequency is set to be 300 Hz and the laser energy density to be from 100 to 400 mJ/cm$^2$ (typically, from 200 to 300 mJ/cm$^2$). When the YAG laser is used, the pulse oscillation frequency is set to be from 30 to 300 kHz by utilizing the second harmonics and the laser energy density to be from 300 to 600 mJ/cm$^2$ (typically, from 350 to 500 mJ/cm$^2$). The whole surface of the substrate is irradiated with the laser beam focused into a line of a width of 100 to 1000 μm, for example, 400 μm, and the overlapping ratio of the linear beam at this moment is set to be 50 to 90%.

Then, a gate insulating film 906 is formed to cover the semiconductor layers 902 to 905. The gate film 906 is formed of an insulating film containing silicon maintaining a thickness of from 40 to 150 nm by the plasma CVD method or the sputtering method. In this embodiment, the gate insulating film is formed of a silicon oxynitride film (composition ratio of Si=32%, O=59%, N=7%, H=2%) maintaining a thickness of 110 nm by the plasma CVD method. The gate insulating film is not limited to the silicon oxynitride film but may have a structure on which is laminated a single layer or plural layers of an insulating film containing silicon.

When the silicon oxide film is to be formed, TEOS (tetraethyl orthosilicate) and $O_2$ are mixed together by the plasma CVD method, and are reacted together under a reaction pressure of 40 Pa, at a substrate temperature of 300 to 400° C., at a high frequency of 13.56 MHz and a discharge electric power density of from 0.5 to 0.8 W/cm$^2$. The thus formed silicon oxide film is, then, heat annealed at 400 to 500° C. thereby to obtain the gate insulating film having good properties.

Then, a heat resistant conductive layer 907 is formed on the gate insulating film 906 maintaining a thickness of from 200 to 400 nm (preferably from 250 to 350 nm) to form the gate electrode (FIG. 11A). The heat resistant conductive laver 907 may be formed as a single layer or may, as required, be formed in a structure of laminated layers of plural layers such as two layers or three layers. The heat resistant conductive layer contains an element selected from Ta, Ti and W, or contains an alloy of the above element, or an alloy of a combination of the above elements. The heat resistant conductive layer is formed by the sputtering method or the CVD method, and should contain impurities at a decreased concentration to decrease the resistance and should, particularly, contain oxygen at a concentration of not higher than 30 ppm. In this embodiment, the W film is formed maintaining a thickness of 300 nm. The W film may be formed by the sputtering method by using W as a target, or may be formed by the heat CVD method by using tungsten hexafluoride ($WF_6$). In either case, it is necessary to decrease the resistance so that it can be used as the gate electrode. It is, therefore, desired that the W film has a resistivity of not larger than 20 μΩcm. The resistance of the W film can be decreased by coarsening the crystalline particles. When W contains much impurity elements such as oxygen, the crystallization is impaired and the resistance increases. When the sputtering method is employed, therefore, a W target having a purity of 99.99990% is used, and the W film is formed while giving a sufficient degree of attention so that the impurities will not be infiltrated from the gaseous phase during the formation of the film, to realize the resistivity of from 9 to 20 μΩcm.

On the other hand, the Ta film that is used as the heat resistant conductive layer 907 can similarly be formed by the sputtering method. The Ta film is formed by using Ar as a sputtering gas. Further, the addition of suitable amounts of Xe and Kr into the gas during the sputtering makes it possible to relax the internal stress of the film that is formed and to prevent the film from being peeled off. The Ta film of α phase has a resistivity of about 20 μΩcm and can be used as the gate electrode but the Ta film of β phase has a resistivity of about 180 μΩcm and is not suited for use as the gate electrode. The TaN film has a crystalline structure close to the α phase. Therefore, if the TaN film is formed under the Ta film, there is easily formed the Ta film of α-phase. Further, though not diagramed, formation of the silicon film doped with phosphorus (P) maintaining a thickness of about 2 to about 20 nm under the heat resistant conductive layer 907 is effective in fabricating the device. This helps improve the intimate adhesion of the conductive film firmed thereon, prevent the oxidation, and prevent trace amounts of alkali metal elements contained in the heat resistant conductive layer 907 from being diffused into the gate insulating film 906 of the first shape. In any way, it is desired that the heat resistant conductive layer 907 has a resistivity over a range of from 10 to 50 μΩcm.

Next, a mask 908 is formed by a resist relying upon the photolithographic technology. Then, a first etching is executed. This embodiment uses an ICP etching apparatus, uses $Cl_2$ and $CF_4$ as etching gases, and forms a plasma with RF (13.56 MHz) electric power of 3.2 W/cm$^2$ under a pressure of 1 Pa. The RF (13.56 MHz) electric power of 224 mW/cm$^2$ is supplied to the side of the substrate (sample stage), too, whereby a substantially negative self bias voltage is applied. Under this condition, the W film is etched at a rate of about 100 nm/min. The first etching treatment is effected by estimating the time by which the W film is just etched relying upon this etching rate, an is conducted for a period of time which is 20% longer than the estimated etching time.

Figure 11B:
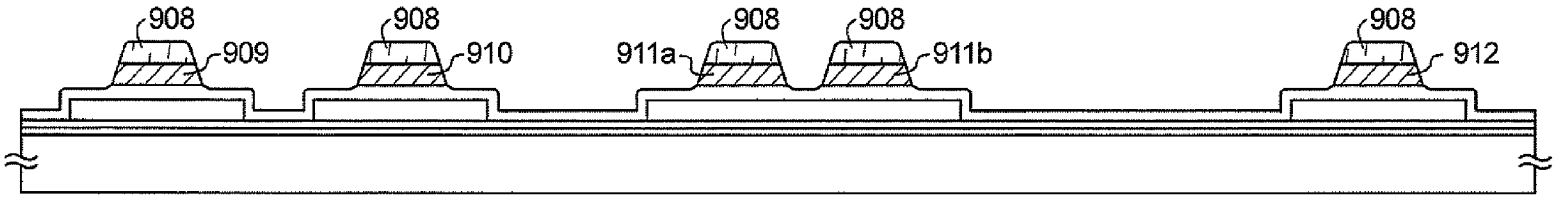

The conductive layers 909 to 912 having a first tapered shape are formed by the first etching treatment. The conductive layers 909 to 912 are tapered at an angle of from 15 to 30°. To execute the etching without leaving residue, over etching, is conducted by increasing the etching time by about 10 to 20%. The selection ratio of the silicon oxynitride film (gate insulating film 906) to the W film is 2 to 4 (typically, 3). Due to the over etching therefore, the surface where the silicon oxynitride film is exposed is etched by about 20 to about 50 mm (FIG. 11B).

Figure 11C:
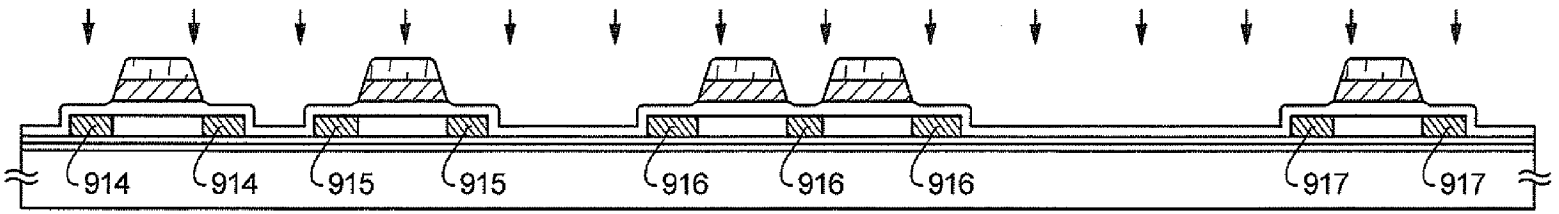

Then, a first doping treatment is effected to add an impurity element of a first type of electric conduction to the semiconductor layer. Here, a step is conducted to add an impurity element for imparting the n-type. A mask 908 forming the conductive layer of a first shape is left, and an impurity element is added by the ion doping method to impart the n-type in a self-aligned manner with the conductive layers 909 to 912 having a first tapered shape as masks. The dosage is set to be from $1\times10^{13}$ to 533 10$^{14}$ to atoms cm$^2$ so that the impurity element for imparting the n-type reaches the underlying semiconductor layer penetrating through the tapered portion and the gate insulating film 906 at the ends of the gate electrode, and the acceleration voltage is selected to be from 80 to 160 keV. As the impurity element for imparting the n-type, there is used an element belonging to the Group 15 in the periodic table and, typically, phosphorus (P) or arsenic (As). Phosphorus (P) is used, here. Due to the ion doping method, an impurity element for imparting the n-type is added to the first impurity regions 914 to 917 over a concentration range of from $1\times10^{20}$ to $1\times10^{21}$ atoms/cm$^3$ (FIG. 11C).

In this step, the impurities turn down to the lower side of the conductive layers 909 to 912 of the first shape depending upon the doping conditions, and it often happens that the first impurity regions 914 to 917 are overlapped with the conductive layers 909 to 912 of the first shape.

Figure 11D:
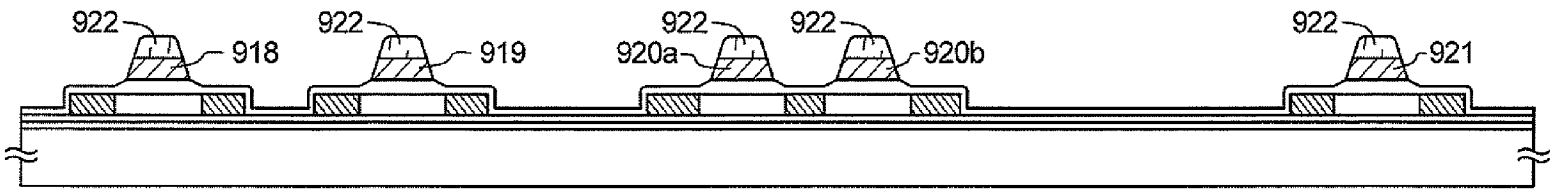

Next, the second etching treatment is conducted as shown in FIG. 11D. The etching treatment, too, is conducted by using the ICP etching apparatus, using a mixed gas of $CF_4$ and $Cl_2$ as an etching gas, using an RF electric power of 3.2 W/cm$^2$ (13.56 MHz), a bias power of 45 mW/cm$^2$ (13.56 MHz) under a pressure of 1.0 Pa. Under this condition, there are formed the conductive layers 918 to 921 of a second shape. The end portions thereof are tapered, and the thicknesses gradually increase from the ends toward the inside. The rate of isotropic etching increases in proportion to a decrease in the bias voltage applied to the side of the substrate as compared to the first etching treatment, and the angle of the tapered portions becomes 30 to 60°. The mask 908 is ground at the edge by etching to form a mask 922. In the step of FIG. 11D, the surface of the gate insulating film 906 is etched by about 40 nm.

Figure 12A:
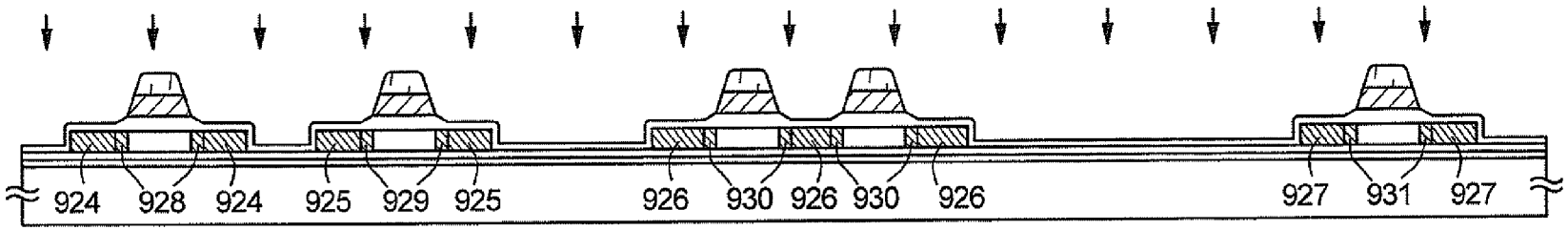
FIGS. 12A to 12C are diagrams showing a process of forming TFTs of Embodiment 6.

Then, the doping is effected with an impurity element for imparting the n-type under the condition of an increased acceleration voltage decreasing the dosage to be smaller than that of the first doping treatment. For example, the acceleration voltage is set to be from 70 to 120 keV, the dosage is set to be $1\times10^{13}$ cm$^2$ thereby to form first impurity regions 924 to 927 having an increased impurity concentration, and second impurity regions 928 to 931 that are in contact with the first impurity regions 924 to 927. In this step, the impurity may turn down to the lower side of the conductive layers 918 to 921 of the second shape, and the second impurity regions 928 to 931 may be overlapped with the conductive layers 918 to 921 of the second shape. The impurity concentration in the second impurity regions is from $1\times10^{16}$ to $1\times10^{18}$ atoms/cm$^3$ (FIG. 12A).

Figure 12B:
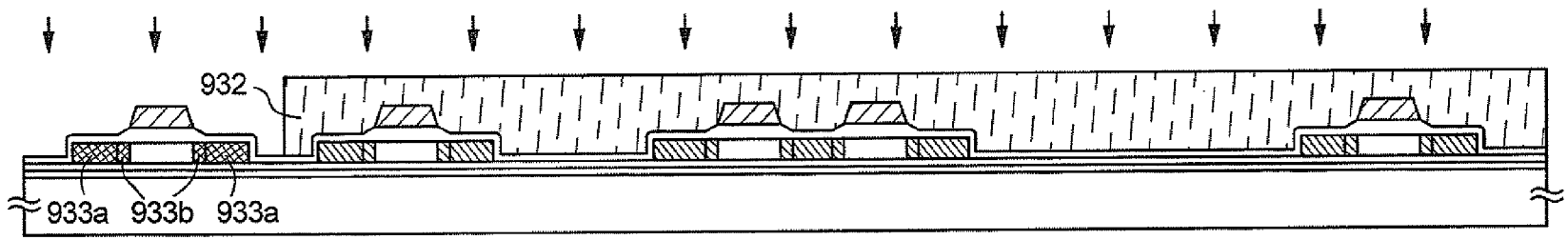

Referring to FIG. 12B, impurity regions 933 (933*a*, 933*b*) of the conductive type opposite to the one conductive type are formed in the semiconductor layers 902 that form the p-channel TFTs. In this case, too, an impurity element for imparting the p-type is added using the electrically conductive layers 918 of the second shape as masks to form impurity regions in a self-aligned manner. At this moment, the semiconductor layers 903, 904 and 905 forming the n-channel TFTs are entirely covered for their surfaces by forming a mask 932 of a resist. Here, the impurity region 933 is formed by the ion doping method by using diborane ($B_2H_6$). The impurity element for imparting the p-type is added to the impurity region 933 at a concentration of from $2\times10^{20}$ to $2\times10^{21}$ atoms/cm$^3$.

If closely considered, however, the impurity region 933 can be divided into two regions containing an impurity element that imparts the n-type. Third impurity regions 933*a* contain the impurity element that imparts the n-type at a concentration of from $1\times10^{20}$ to $1\times10^{21}$ atoms/cm$^3$ and fourth impurity regions 933*b* contain the impurity element that imparts the n-type at a concentration of from $1\times10^{17}$ to $1\times10^{20}$ atoms/cm$^3$. In the impurity regions 933*b*, however, the impurity element for imparting the p-type is contained at a concentration of not smaller than $1\times10^{19}$ atoms/cm$^3$ and in the third impurity regions 933*a*, the impurity element for imparting the p-type is contained at a concentration which is 1.5 to 3 times as high as the concentration of the impurity element for imparting the n-type. Therefore, the third impurity regions work as source regions and drain regions of the p-channel TFTs without arousing any problem.

Figure 12C:
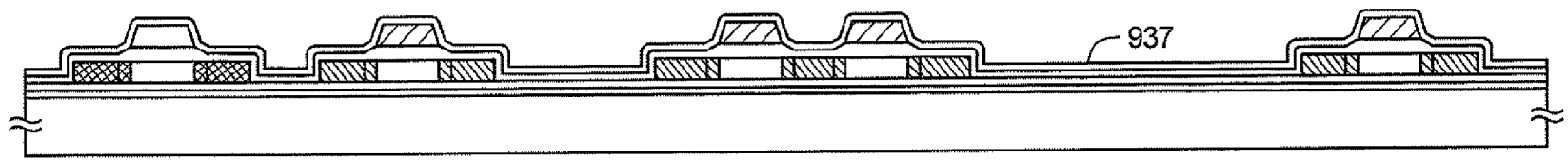

Referring next to FIG. 12C, a first interlayer insulating film 937 is formed on the electrically conductive layers 918 to 921 of the second shape and on the gate insulating film 906. The first interlayer insulating film 937 may be formed of a silicon oxide film, a silicon oxynitride film, a silicon nitride film, or a laminated layer film of a combination thereof. In any case, the first interlayer insulating film 937 is formed of an inorganic insulating material. The first interlayer insulating film 937 has a thickness of 100 to 200 nm. When the silicon oxide film is used as the first interlayer insulating film 937, TEOS and $O_2$ are mixed together by the plasma CVD method, and are reacted together under a pressure of 40 Pa at a substrate temperature of 300 to 400° C. while discharging the electric power at a high frequency (13.56 MHz) and at a power density of 0.5 to 0.8 W/cm$^2$. When the silicon oxynitride film is used as the first interlayer insulating film 937, this silicon oxynitride film may be formed from $SiH_4$, $N_2$0 and $NH_3$, or from $SiH_4$ and $N_2O$ by the plasma CVD method. The conditions of formation in this case are a reaction pressure of from 20 to 200 Pa, a substrate temperature of from 300 to 400° C. and a high frequency (60 MHz) power density of from 0.1 to 1.0 W/cm$^2$. As the first interlayer insulating film 937, further, there may be used a hydrogenated silicon oxynitride film formed by using $SiH_4$, $N_2$0 and $H_2$. The silicon nitride film, too, can similarly be formed by using $SiH_{4\ and\ NH3}$ by the plasma CVD method.

Then, a step is conducted for activating the impurity elements that impart the n-type and the p-type added at their respective concentrations. This step is conducted by thermal annealing method using an annealing furnace. There can be further employed a laser annealing method or a rapid thermal annealing method (RTA method). The thermal annealing method is conducted in a nitrogen atmosphere containing oxygen at a concentration of not higher than 1 ppm and, preferably, not higher than 0.1 ppm at from 400 to 700° C. and, typically at from 500 to 600° C. In this embodiment, the heat treatment is conducted at 550° C. for 4 hours. When a plastic substrate having a low heat resistance temperature is used as the substrate 900, it is desired to employ the laser annealing method.

Following the step of activation, the atmospheric gas is changed, and the heat treatment is conducted in an atmosphere containing 3 to 100% of hydrogen at from 300 to 450° C. for from 1 to 12 hours to hydrogenate the semiconductor layer. This step is to terminate the dangling bonds of $10^{16}$ to $10^{15}/cm^3$ in the semiconductor layer with hydrogen that is thermally excited. As another means of hydrogenation, the plasma hydrogenation may be executed (using hydrogen excited with plasma). In any way, it is desired that the defect density in the semiconductor layers 902 to 905 is suppressed to be not larger than $10^{16}/cm^3$. For this purpose, hydrogen may be added in an amount of from 0.01 to 0.1 atomic %.

Then, a second interlayer insulating film 939 of an organic insulating material is formed maintaining an average thickness of from 1.0 to 2.0 μm. As the organic resin material, there can be used polyimide, acrylic resin, polyamide, polyimide-amide, BCB (benzocyclobutene) as well as photosensitive acrylic resin. When there is used, for example, a polyimide of the type that is heat polymerized after being applied onto the substrate, the second interlayer insulating film is formed being fired in a clean oven at 300° C. When there is used an acrylic resin, there is used the one of the two-can type. Namely, the main material and a curing agent are mixed together, applied onto the whole surface of the substrate by using a spinner, pre-heated by using a hot plate at 80° C. for 60 seconds, and are fired at 250° C. for 60 minutes in a clean oven to form the second interlayer insulating film.

Thus, the second interlayer insulating film 939 is formed by using an organic insulating material featuring good and flattened surface. Further, the organic resin material, in general, has a small dielectric constant and lowers the parasitic capacitance. The organic resin material, however, is hygroscopic and is not suited as a protection film. It is, therefore, desired that the second interlayer insulating film is used in combination with the silicon oxide film, silicon oxynitride film or silicon nitride film formed as the first interlayer insulating film 937.

Thereafter, the resist mask of a predetermined pattern is formed, and contact holes are formed in the semiconductor layers to reach the impurity regions serving as source regions or drain regions. The contact holes are formed by dry etching. In this case, a mixed gas of $CF_4$, $O_2$ and He is used as the etching gas to, first, etch the second interlayer insulating film 939 of the organic resin material. Thereafter, $CF_4$ and $O_2$ are used as the etching gas to etch the first interlayer insulating film 937. In order to further enhance the selection ratio relative to the semiconductor layer, $CHF_3$ is used as the etching gas to etch the gate insulating film 906 of a third shape, thereby to form the contact holes.

Next, the conductive metal film is formed by sputtering and vacuum vaporization. The source wirings 940 to 943, the drain wiring 944 to 945 and the pixel electrode 947 are formed by patterning by masks and etching the conductive metal film. Note that, in this embodiment, the wiring is a lamination film of three layers structured with from the lower layer side, a titanium film with a thickness of 50 nm, an aluminum film containing titanium with a thickness of 200 nm, and an aluminum film containing lithium with a thickness of 200 nm formed continuously by a sputtering method. Further, a vaporization method may be used in formulation of only an aluminum film containing lithium. However, in such a case continuous formation without exposure to the air is preferable.

Figure 13A:
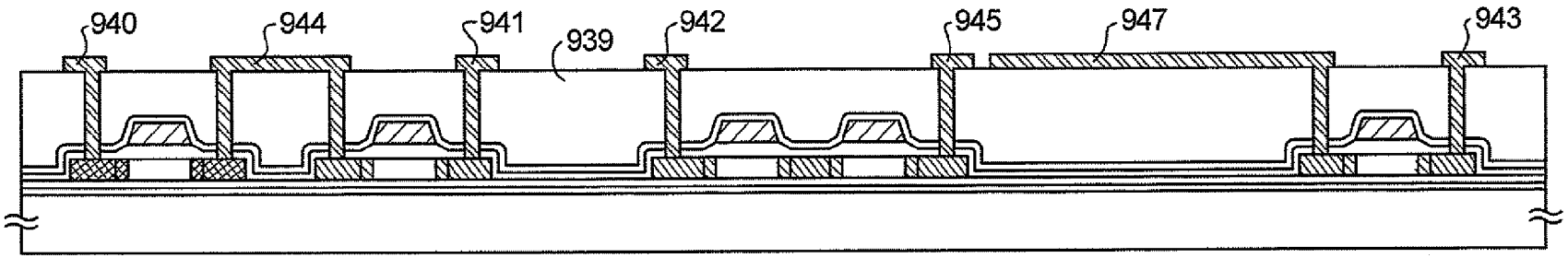
FIGS. 13A and 13B are diagrams showing a process of forming TFTs of Embodiment 6.

It is important here to make the outermost surface of the pixel electrode 947 from a metal having a small work function. This is because the pixel electrode 947 itself is to function as the cathode of the light emitting element. For that reason, at least the outermost surface of the pixel electrode 947 has to be a metal film containing an element that belongs to Group 1 or 2 in the periodic table, or a bismuth (Bi) film. Since the source wiring lines 940 to 943 and drain wiring lines 944 to 945 are formed at the same time the pixel electrode 947 is formed, the same conductive film is used for the wiring lines and the pixel electrode (FIG. 13A).

Figure 13B:
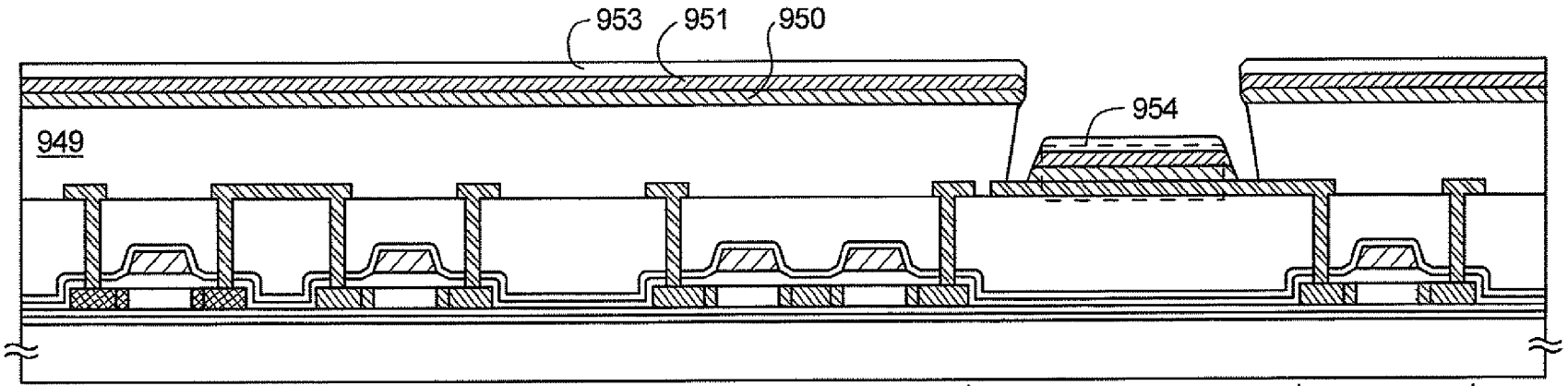

Next, a third interlayer insulating film 949 having, an aperture at a position that coincides with the pixel electrode 947 is formed as shown in FIG. 13B. The third interlayer insulating film 949 is capable of insulating, and functions as a bank to separate organic compound layers of adjacent pixels from each other. This embodiment uses a resist for the third interlayer insulating film 949.

In this embodiment, the third interlayer insulating film 949 is about 1 μm in thickness and the aperture is shaped to have a so-called reverse tapered shape in which the width is increased toward the pixel electrode 947. This is obtained by covering the resist film with a mask except the portion where the aperture is to be formed, exposing the film through irradiation of UV light, and then removing the exposed portion using a developer. Another purpose of providing the third interlayer insulating film 949 is to avoid direct contact between the organic compound layer including a light emitting layer to be formed next and the edge of the pixel electrode 947.

The third interlayer insulating film 949 reversely tapered as in this embodiment separates organic compound layers of adjacent pixels from each other when the organic compound layers are formed in a later step. Therefore cracking or peeling of the organic compound layers can be prevented even if the organic compound layers and the third interlayer insulating film 949 have thermal expansion coefficients different from each other.

Although a resist film is used in this embodiment for the third interlayer insulating film 949, polyimide, polyamide, acrylic, BCB (benzocycrobutene), or silicon oxide film may be used in some cases. The third interlayer insulating film 949 may be organic or inorganic as long as the material is capable of insulating.

An organic compound layer 950 is formed by evaporation. In this embodiment, a laminate of an electron injection layer and a light emitting layer is called an organic compound layer. An organic compound layer defined herein is a laminate obtained by combining a light emitting layer with one or some of a hole injection layer, a hole transporting layer, a hole blocking layer, an electron transporting layer, an electron injection layer, and an electron blocking layer. The layers may be organic or inorganic, or may be high molecular material (polymer) or low molecular material.

In this embodiment, a lithium fluoride (LiF) film with a thickness of 20 nm is formed first as an electron injection layer, and then an aluminoquinolilate complex ($Alq_3$) is deposited to a thickness of 80 nm as a light emitting layer. The light emitting layer may be doped with a dopant (typically, a fluorescent pigment) serving as luminescent center through coevaporation.

After the organic compound layer 950 is formed, an anode 951 is formed to a thickness of 300 nm from a conductive oxide film that has a large work function and is transparent to visible light. In this embodiment, zinc oxide is doped with gallium oxide through evaporation to form a conductive oxide film. Examples of other usable conductive oxide films include an indium oxide film, a zinc oxide film, a tin oxide film, and a film of a compound obtained by containing indium oxide, zinc oxide, and tin oxide. Thus completed is a light emitting element 954 that is composed of the pixel electrode (cathode) 947, the organic compound layer 950, and the anode 951.

It is effective to form a protective film 953 so as to completely cover the light emitting element 954 after the anode 951 is formed. The protective film 953 is a single layer or a laminate of insulating films including a carbon film, a silicon nitride film, and a silicon oxynitride film.

Preferably, a film that has a good coverage is used for the protective film, and a carbon film, especially a DLC (diamond-like carbon) film, is effective. A DLC film can be formed at a temperature ranging from room temperature to 100° C. and therefore it is easy to form a DLC film above the organic compound layer 950 that has low heat resistance. In addition, a DLC film has high oxygen blocking effect and can prevent oxidization of the organic compound layer 950. Accordingly, it is possible to prevent for the organic compound layer 950 from being oxidized in the subsequent sealing step.

A display panel structured as shown is FIG. 13B is thus completed.

A p-channel TFT 960 and an n-channel TFT 961 are TFTs of the first memory or the second memory. Denoted by 962 is a first switching TFT and 963, a current controlling TFT.

The manufacture method shown in this embodiment is capable of forming TFTs of a driving circuit and TFTs of a pixel portion at the same time. In the case of a light emitting device using a light emitting element, its driving circuit can be operated by a power supply having a voltage in the order of 5 to 6V, and about 10 V at most. Therefore, degradation of TFTs due to hot electron is not a serious problem. Also, smaller gate capacitance is preferred for the TFTs since the driving circuit needs to operate at high speed. Accordingly, TFTs having the structure of this embodiment in which the second impurity region and the fourth impurity region of the semiconductor layers of the TFTs do not overlap the gate electrodes, are preferable as TFTs in a driving circuit of a light emitting device.

The method of manufacturing the light emitting device of the present invention is not limited to the one described in this embodiment. The light emitting device of the present invention may be manufactured by a known method.

This embodiment may be combined freely with Embodiments 1 through 5.

Embodiment 7

This embodiment describes a different method of manufacturing a light emitting device than the method in Embodiment 6.

Figure 14A:
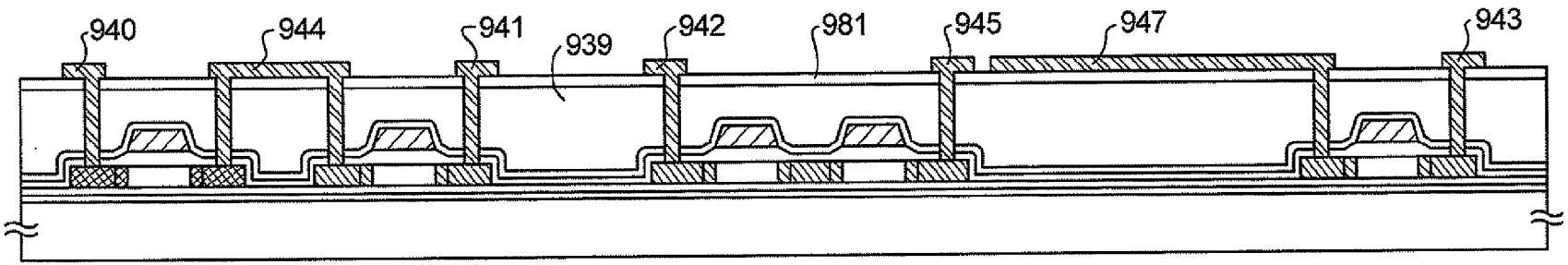
FIGS. 14A and 14B are diagrams showing a process of forming TFTs of Embodiment 7.

Steps up through the step of forming the second insulating film 939 are the same as Embodiment 6. After the second interlayer insulating film 939 is formed, a passivation film 981 is formed such that it is in contact with the second interlayer insulating film 939 as shown in FIG. 14A.

The passivation film 981 is effective in preventing moisture contained in the second interlayer insulating film 939 from seeping into the organic compound layer 950 through the pixel electrode 947 and a third interlayer insulating film 982. Providing the passivation film 981 is effective especially when the second interlayer insulating film 939 has an organic resin material since organic resin materials contain a lot of moisture.

In this embodiment, a silicon nitride film is used as the passivation film 981.

Thereafter, a resist mask having a given pattern is formed and contact holes are formed to reach impurity regions that serve as source regions or drain regions in the respective semiconductor layers. The contact holes are formed by dry etching. In this case, a mixture gas of CF4 and 02 is used as etching gas to etch the passivation film 981 first, and then, a mixture gas of $CF_4$, $O_2$, and He is used as etching gas to etch the second interlayer insulating film 939 formed of an organic resin material. Then the etching gas is changed to $CF_4$ and $O_2$ to etch the first interlayer insulating film 937. The etching gas is further switched to $CHF_3$ in order to raise the selective ratio with respect to the semiconductor layers, and the gate insulating film 906 is etched to form the contact holes.

A conductive metal film is formed by sputtering or vacuum evaporation and is patterned using a mask. The film is then etched to form source wiring lines 940 to 943, drain wiring lines 944 to 945, and a pixel electrode 947. The wiring lines in this embodiment are a laminate having a three-laver structure. The three layers are a 50 nm thick titanium film as the bottom layer, a 200 nm thick titanium-containing aluminum film as the middle layer, and a 200 nm thick lithium-containing aluminum film as the top layer, which are formed in succession by sputtering. The lithium-containing aluminum film alone may be formed by evaporation instead of sputtering. In this case also, successive film formation without exposure to the air is desirable.

It is important here to make the outermost surface of the pixel electrode 947 from a metal having a small work function. This is because the pixel electrode 947 itself is to function as the cathode of the light emitting element. For that reason, at least the outermost surface of the pixel electrode 947 has to be a metal film containing an element that belongs to Group 1 or 2 in the periodic table, or a bismuth (Bi) film. Since the source wiring lines 940 to 943 and drain wiring lines 944 and 945 are formed at the same time the pixel electrode 947 is formed, the same conductive film is used for the wiring lines and the pixel electrode.

Figure 14B:
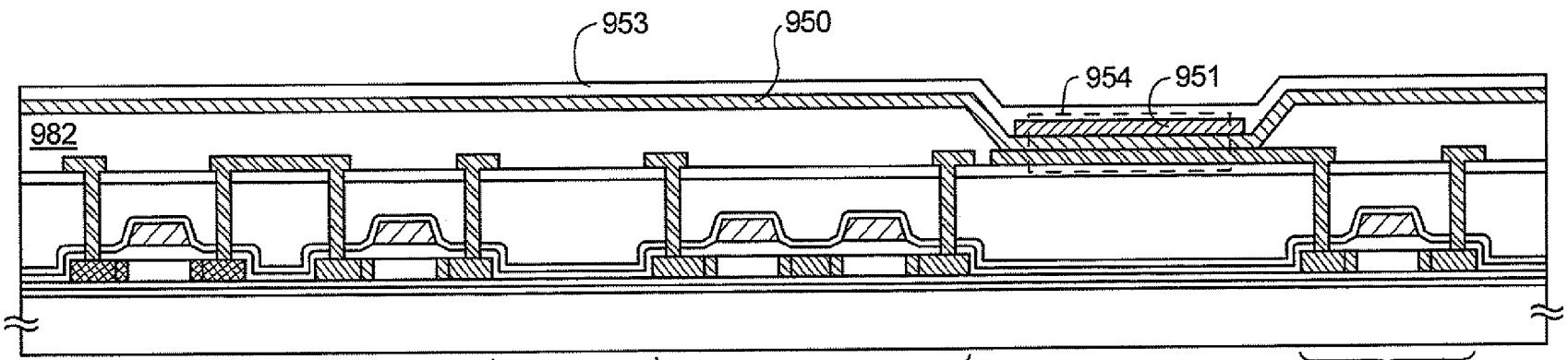

Next, the third interlayer insulating film 982 having an aperture at a position that coincides with the pixel electrode 947 is formed as shown in FIG. 14B. This embodiment uses wet etching in forming the aperture, thereby shaping it into tapered side walls. Unlike the case shown in Embodiment 6, organic compound layers to be formed on the third interlayer insulating film 982 are not separated from each other. Therefore, side walls of the aperture have to be tapered gently. Otherwise, degradation of organic compound layers caused by the level difference will be a serious problem.

Although a silicon oxide film is used in this embodiment as the third interlayer insulating film 982, a film of an organic resin such as polyimide, polyamide acrylic, or BCB (benzocycrobutene) may be used in some cases.

Preferably, plasma treatment using argon is performed on the surface at the third interlayer insulating film 982 before forming the organic compound layer 950 on the third interlayer insulating film 982, thereby increasing the density of the surface of the third interlayer insulating film 982. With the above structure, moisture from the third interlayer insulating film 982 is prevented from seeping into the organic compound layer 950.

The organic compound layer 950 is formed by evaporation. In this embodiment, a laminate of an electron injection layer and a light emitting layer is called an organic compound layer. That is, an organic compound layer defined herein is a laminate obtained by combining a light emitting layer with one or some of a hole injection layer, a hole transporting layer, a hole blocking layer, an electron transporting layer, an electron injection layer, and an electron blocking layer. The layers may be organic or inorganic, or may be polymer or monomer.

In this embodiment, a lithium fluoride (LiF) film with a thickness of 20 nm is formed first as an electron injection layer, and then an aluminoquinolilate complex ($Alq_3$) is deposited to a thickness of 80 nm as a light emitting layer. The light emitting layer may be doped with a dopant (typically, a fluorescent pigment) serving as luminescent center through coevaporation.

After the organic compound layer 950 is formed, all anode 951 is formed into a thickness of 300 nm from a conductive oxide film that has a large work function and is transparent to visible light. In this embodiment, zinc oxide is doped with gallium oxide through evaporation to form a conductive oxide film. Examples of other usable conductive oxide films include an indium oxide film, a zinc oxide film, a tin oxide film, and a film of a compound obtained by combining indium oxide, zinc oxide, and tin oxide. Thus completed is a light emitting element 954 that is composed of the pixel electrode (cathode) 947, the organic compound layer 950, and the anode 951.

It is effective to form a protective film 953 so as to completely cover the light emitting element 954 after the anode 951 is formed. The protective film 953 is a single layer or a laminate of insulating films including a carbon film, a silicon nitride film, and a silicon oxynitride film.

Preferably, at this time, a film that can cover a large area is used for the protective film, and a carbon film, especially a DLC (diamond-like carbon) film, is effective. A DLC film can be formed at a temperature ranging from room temperature to 100° C. and therefore it is easy to form a DLC film above the organic compound layer 950 that has low heat resistance. In addition, a DLC film has high oxygen blocking effect and can prevent oxidization of the organic compound layer 950. Accordingly, there is no chance for the organic compound layer 950 to be oxidized before the subsequent sealing step.

A display panel structured as shown in FIG. 14B is thus completed.

A p-channel TFT 960 and an n-channel TFT 961 are TFTs of the first memory or the second memory. Denoted by 962 is a first switching TFT and 963, a current controlling, TFT The manufacture method shown in this embodiment is capable of forming TFTs of a driving circuit and TFTs of a pixel portion at the same time. In the case of a light emitting device using a light emitting element, its driving circuit can be operated by a power supply having a voltage of 5 to 6V, 10 V, at most. Therefore, degradation of TFTs in the driving circuit due to hot electron is not a serious problem. Also, smaller gate capacitance is preferred for the TFTs since the driving circuit needs to operate at high speed. Accordingly, TFTs having the structure of this embodiment in which the second impurity region and the fourth impurity region of the semiconductor layers of the TFTs do not overlap the gate electrodes, are more preferable as TFTs in a driving circuit of a light emitting device.

The method of manufacturing the light emitting device of the present invention is not limited to the one described in this embodiment. The light emitting device of the present invention may be manufactured by a known method.

This embodiment may be combined freely with Embodiments 1 through 7.

Embodiment 8

This embodiment describes a case of employing a TFT whose active layer is formed of an organic semiconductor for a TFT used in a light emitting device of the present invention. A TFT having an organic semiconductor as its active layer is hereinafter referred to as an organic TFT.

Figure 18A:
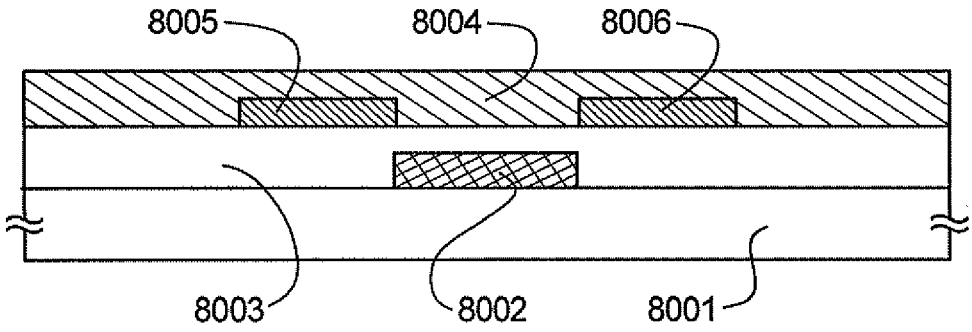
FIGS. 18A to 18C are sectional views of organic TFTs of Embodiment 5.

FIG. 18A is a sectional view of a planar organic TFT. A gate electrode 8002 is formed on a substrate 8001. A gate insulating film 8003 is formed over the substrate 8001 while covering the gate electrode 8002. On the gate insulating film 8003, a source electrode 8005 and a drain electrode 8006 are formed. An organic semiconductor film 8004 is formed on the gate insulating film 8003 while covering the source electrode 8005 and the drain electrode 8006.

Figure 18B:
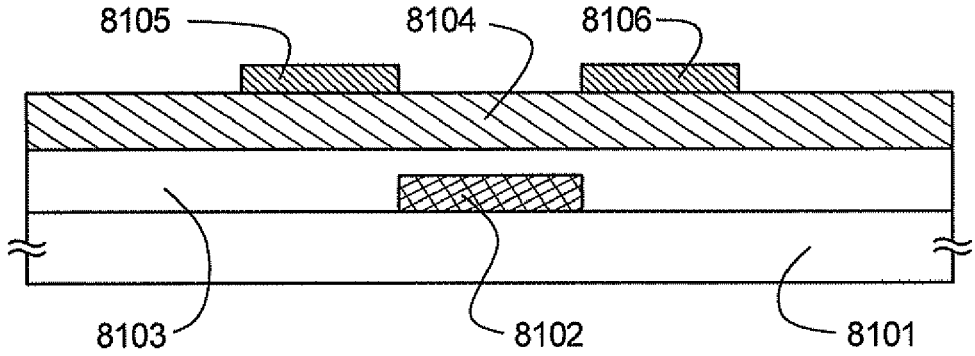

FIG. 18B is a sectional view of an inverted stagger organic TFT. A gate electrode 8102 is formed on a substrate 8101. A gate insulating film 8103 is formed over the substrate 8101 while covering the gate electrode 8102. On the gate insulating film 8103, an organic semiconductor film 8104 is formed. A source electrode 8105 and a drain electrode 8106 are formed on the organic semiconductor film 8104.

Figure 18C:
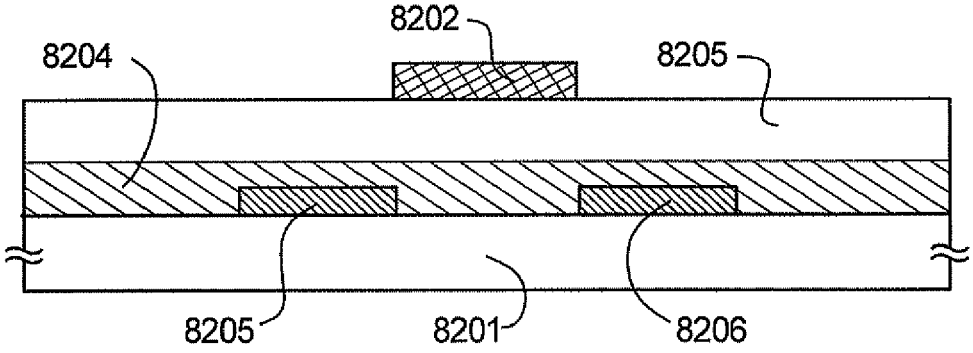

FIG. 18C is a sectional view of a stagger organic TFT. A source electrode 8205 and a drain electrode 8206 are formed on a substrate 8201. An organic semiconductor film 8204 is formed over the substrate 8201 while covering the source electrode 8205 and the drain electrode 8206. On the organic semiconductor film 8204, a gate insulating film 8203 is formed. A gate electrode 8202 is formed on the gate insulating film 8203.

Organic semiconductors are classified into high molecular weight ones and low molecular weight ones. Examples of the typical high molecular weight material include polythiophene, polyacetylene, poly(N-methylpyrrole), poly(3-alkylthiophene), and polyallylenevinylene.

An organic semiconductor film containing polythiophene can be formed by electric field polymerization or vacuum evaporation. An organic semiconductor film containing polyacetylene can be formed by chemical polymerization or coating. An organic semiconductor film containing poly(N-methylpyrrole) can be formed by chemical polymerization. An organic semiconductor film containing poly(3)-alkylthiophene) can be formed by application or the LB method. An organic semiconductor film containing polyallylenevinylene can be formed by coating.

Examples of the typical low molecular weight material include quarter thiophene, dimethyl quarter thiophene, diphthalocyanine, anthracene, and tetracene. Organic semiconductor films containing these low molecular weight materials are mainly formed by evaporation or casting using a solvent.

The structure of this embodiment can be combined freely with the structures of Embodiments 1 through 7.

Embodiment 9

In this embodiment, an external light emitting quantum efficiency can be remarkably improved by using an organic compound material by which phosphorescence from a triplet exciton can be employed or emitting a light. As a result, the power consumption of the light emitting element can be reduced, the lifetime of the light emitting element can be elongated and the weight of the light emitting element can be lightened.

The following is a report where the external light emitting quantum efficiency is improved by using the triplet exciton (T. Tstutsui, C. Adachi, S. Saito, Photochemical processes in Organized Molecular Systems, ed. K. Honda, (Elsevier Sci. Pub., Tokyo, 1991) p. 437).

The molecular formula of an organic compound material (coumarin pigment) reported by the above article is represented as follows.

(Chemical formula 1)

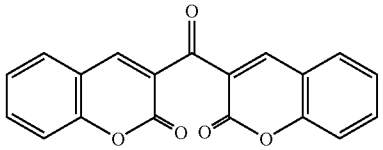

(M. A. Baldo, D. F. O'Brien, Y. You, A. Shoustikov, S. Sibley, M. E. Thompson, S. R. Forrest, Nature 395 (1998) p. 151)

The molecular formula of an organic compound material (Pt complex) reported by the above article is represented as follows.

(Chemical formula 2)

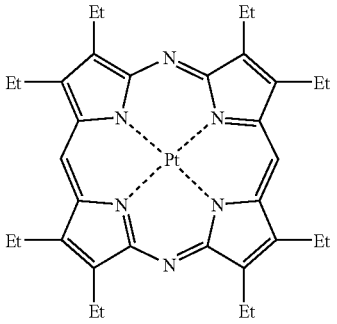

(M. A. Baldo, S. Lamansky, P. E. Burrows, M. E. Thompson, S. R. Forrest, Appl. Phys. Lett., 75 (1999) p. 4.)

(T. Tsutsui, M. -J. Yang, M. Yahiro, K. Nakamura, T. Watanabe, T. Tsuji, Y. Fukuda, T. Wakimoto, S. Mayaguchi, Jpn, Appl. Phys., 38(128) (1999) L1502)

The molecular formula of an organic compound material (Ir complex) reported by the above article is represented as follows.

(Chemical formula 3)

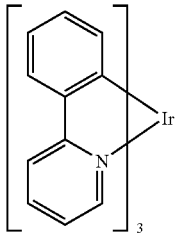

As described above, if phosphorescence from a triplet exciton can be put to practical use, it can realize the external light emitting quantum efficiency three to four times as high as that in the case of using fluorescence from a singlet exciton in principle.

The structure according, to Embodiment 9 can be freely implemented in combination of any structures of Embodiments 1 to 8.

Embodiment 10

Figure 19:
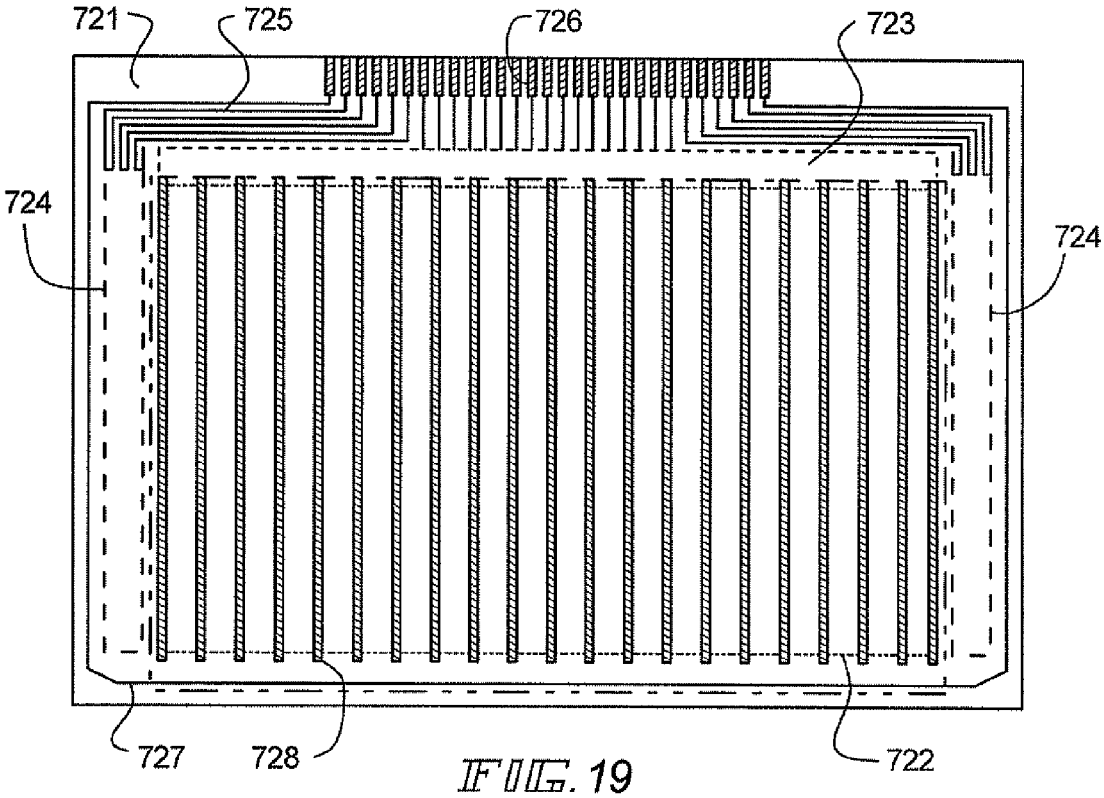
FIG. 19 is a top view of a light emitting device of Embodiment 10.

FIG. 19 is a diagram showing the exterior of a light emitting device. In FIG. 19, a pixel portion 722, a gate signal line driving circuit 724, a source signal line driving circuit 723, and terminals 726 are formed over a substrate 721. The terminals 726 are connected to the driving circuits through lead-out wiring lines 725. Wiring lines 728 that also serve as partition layers are formed in the pixel portion 722 in the direction in which signal lines for inputting video signals extend. These wiring lines 728 include source signal lines and power supply lines. Details thereof are omitted here. Of the wiring lines 728, power supply lines are connected to the terminals 726 through lead-out wiring lines 725.

Lead-out wiring lines 727 are for connecting opposite electrodes to the terminals.

If necessary, an IC chip having a CPU, a memory, and the like may be mounted to the element substrate by COG (chip on glass) or other methods.

Figure 20:
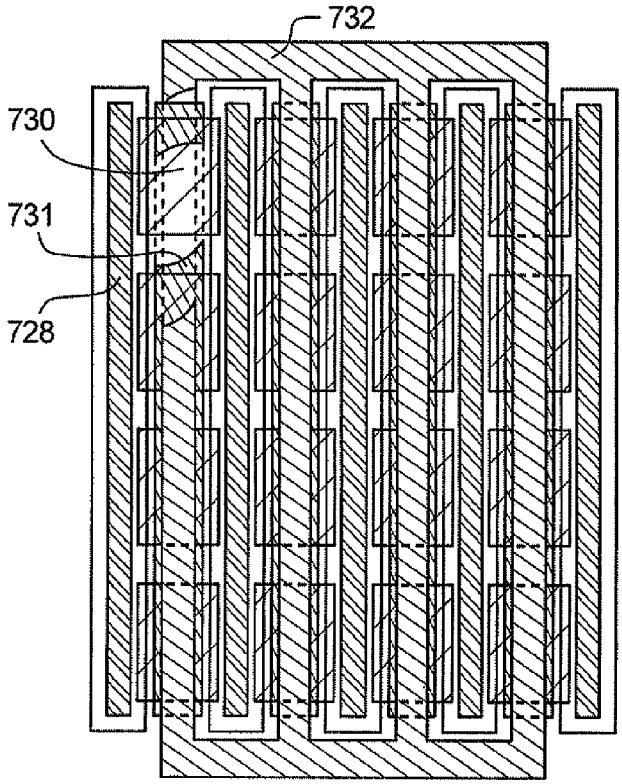
FIG. 20 is a top view of a light emitting device of Embodiment 10.

A light emitting element is formed between the wiring lines 728. The structure of the light emitting element is shown in FIG. 20. A pixel electrode 730 is an electrode provided for each pixel and is formed between the wiring lines 728. In the layer above the pixel electrode, an organic compound layer 731 is formed between the wiring lines 728. Organic compound layers are continuously formed to make a stripe pattern over the plural pixel electrodes.

An opposite electrode 732 is formed in the layer above the organic compound layer 731. Opposite electrodes are similarly formed between the wiring lines 728 to make a stripe pattern. The opposite electrode 732 is connected in a region that is not sandwiched between the wiring lines 728, namely, a region outside the pixel portion 722. The connection point may be located at one or both ends of the opposite electrode.

The lead-out wiring lines 727 are formed in the same layer as gate signal lines (not shown in the drawing), and are not in direct contact with the wiring lines 728. Contacts are made at points where the lead-out wiring lines 727 overlap the opposite electrodes.

The light emitting element is defined by a region where the pixel electrode 730, the organic compound laxer 731, and the opposite electrode 732 overlap. In an active matrix light emitting device, pixel electrodes are individually connected to active elements. If an opposite electrode has a defect and there is a defect inside a pixel portion, it may be recognized as a linear defect. However, the possibility of such linear defect taking place can be low in the structure in which both ends of the opposite electrode are connected to make a common electrode as shown in FIG. 20.

Embodiment 11

The light emitting device is of the self-emission type, and thus exhibits more excellent recognizability of the displayed image in a light place as compared to the liquid crystal display device. Furthermore, the self-emission device has a wider viewing angle. Accordingly, the light emitting device can be applied to a display portion in various electronic devices.

Such electronic devices using a light emitting device of the present invention include a video camera, a digital camera, a goggles type display (head mount display), a navigation system, a sound reproduction device (a car audio equipment and an audio set), note-size (notebook) personal computer, a game machine, a portable information terminal (a mobile computer, a portable telephone (cellular phone), a portable (game machine, an electronic book, or the like), an image reproduction apparatus including a recording medium (more specifically, an apparatus which can reproduce a recording medium such as a digital video disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIGS. 15A to 15H respectively show various specific examples of such electronic devices.

Figure 15A:
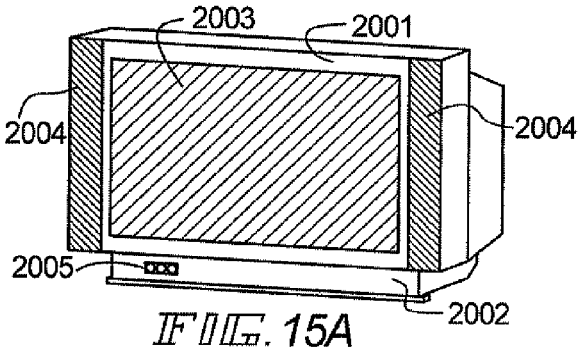
FIGS. 15A to 15H are diagrams showing electronic apparatus using a light emitting device of Embodiment 11.

FIG. 15A illustrates an electro-luminescence display device which includes a frame 2001, a support table 2002, a display portion 2003, a speaker portion 2004, a video input terminal 2005 or the like. The present invention is applicable to the display portion 2003. The light emitting device is of the self-emission type and therefore requires no back-light. Thus, the display portion thereof can have a thickness thinner than that of the liquid crystal display device. The electro luminescence display device is including all of the display device for displaying information, such as a personal computer, a receiver of TV broadcasting and an advertising display.

Figure 15B:
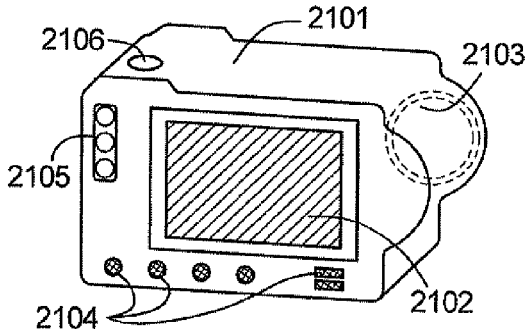

FIG. 15B illustrated a digital still camera which includes a main body 2101, a display portion 2102, an image receiving portion 2103, an operation key 2104, an external connection port 2105, a shutter 2106, or the like. The light emitting device in accordance with the present invention can be held as the display portion 2102.

Figure 15C:
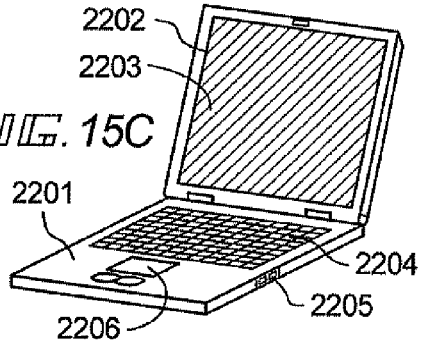

FIG. 15C illustrates a laptop (notebook) computer which includes a main body 2201, a casing 2202, a display portion 2203, a keyboard 2204, an external connection port 2205, a pointing mouse 2206, or the like. The light emitting device in accordance with the present invention can be used as the display portion 2203.

Figure 15D:
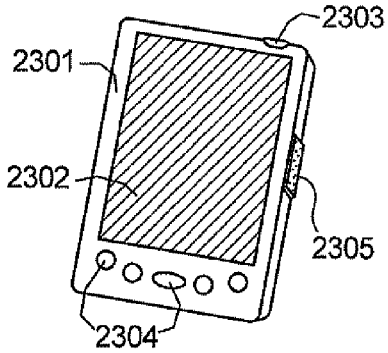

FIG. 15D illustrated a mobile computer which includes a main body 2301, a display portion 2302, a switch 2303, an operation key 2304, an infrared port 2305, or the like. The light emitting device in accordance with the present invention can be used as the display portion 2302.

Figure 15E:
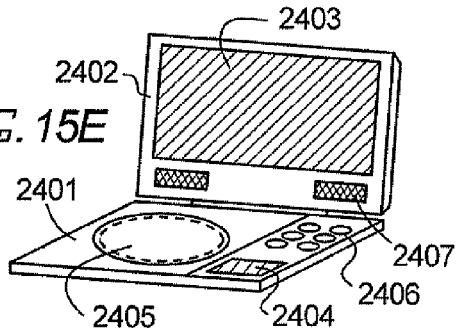

FIG. 15E illustrates an image reproduction apparatus including a recording medium (more specifically, a DVD reproduction apparatus), which includes a main body 240l, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The light-emitting device in accordance with the present invention can be used as these display portions A 2403 and B 2404. The image reproduction apparatus including a recording medium further includes a gate machine or the like.

Figure 15F:
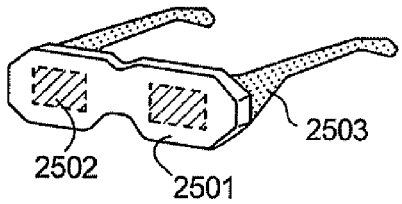

FIG. 15F illustrates a goggle type display (head mounted display) which includes a main body 2501, a display portion 2502, an arm portion 2503. The light emitting device in accordance with the present invention can be used as the display portion 2502.

Figure 15G:
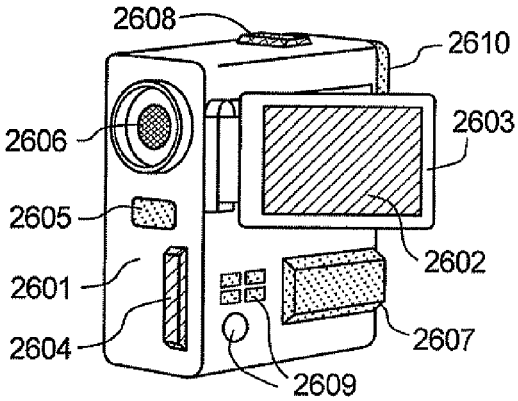

FIG. 15G illustrates a video camera which includes a main body 2601, a display portion 2602, a casing, 2603, an external connecting port 2604, a remote control receiving portion 2605, an image receiving portion 2606, a battery 2607, a sound input portion 2608, an operation key 2609, an eyepiece portion 2610, or the like. The light emitting device in accordance with the present invention can be used as the display portion 2602.

Figure 15H:
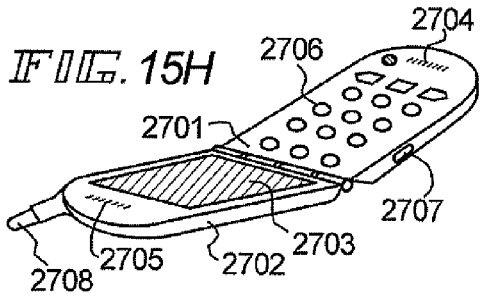
Figure 16:
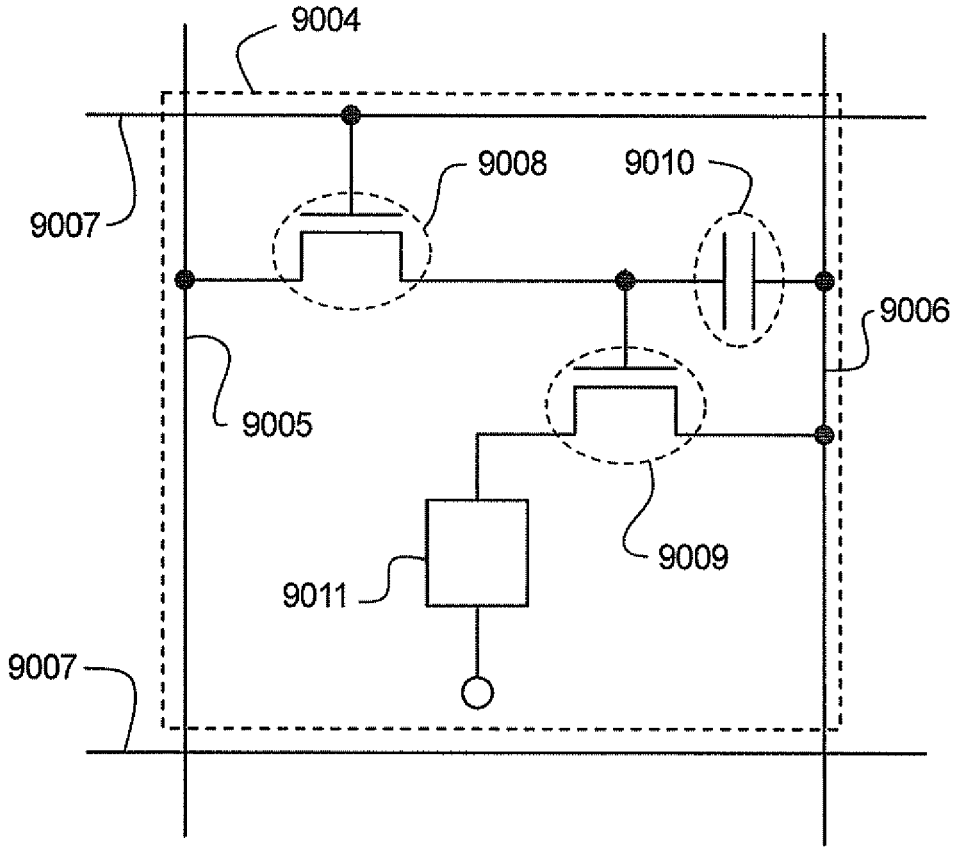
FIG. 16 PRIOR ART
FIG. 16 is a circuit diagram of a conventional pixel.
Figure 17:
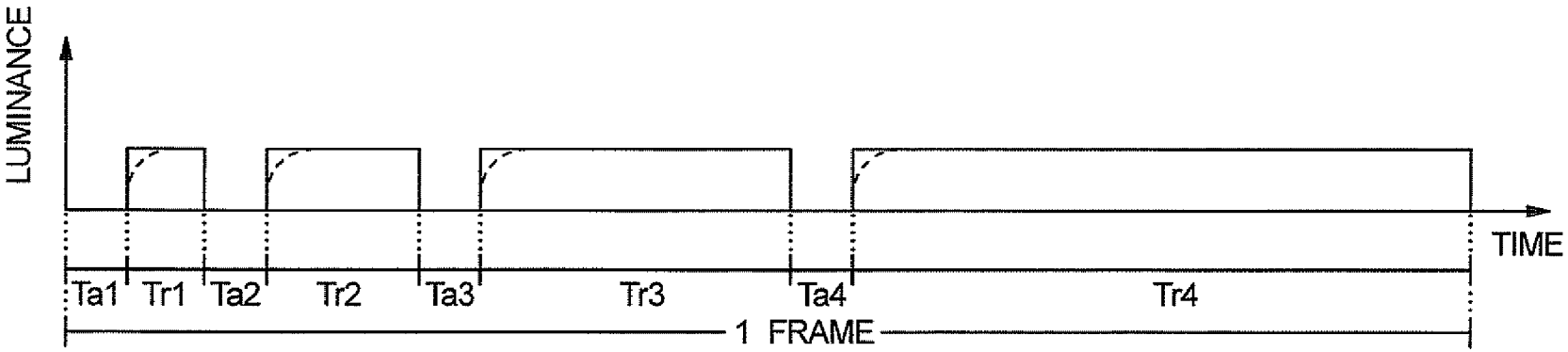
FIG. 17 PRIOR ART
FIG. 17 is a diagram showing a method of driving a conventional pixel.

FIG. 15H illustrates a mobile phone (cellular phone) which includes a main body 2701, a casing 2702, a display portion 2703, a sound input portion 2704, a sound output portion 2705, an operation key 2706, an external connecting port 2707, an antenna 2708, or the like. The light emitting device in accordance with the present invention can be used as the display portion 2703. Note that the display portion 2703 can reduce power consumption of the portable telephone by displaying white colored characters on a black colored background.

When the brighter luminance of light emitted from the organic compound layer becomes available by adding the electric field in the future, the light emitting device in accordance with the present invention will be applicable to a front type or rear type projector in which light including output image information is enlarged by means of lenses or the like to be projected.

The aforementioned electronic devices are more likely to be used for display information distributed through a telecommunication path such as Internet, a CATV (cable television system), and in particular likely to display moving picture information. The light emitting device is suitable for displaying moving pictures since the organic compound material can exhibit high response speed.

A portion of the light emitting device that is emitting light consumes power, so it is desirable to display information in such a manner that the light emitting portion therein becomes as small as possible. Accordingly, when the self-emission device is applied to a display portion which mainly displays character information, e.g., a display portion of a portable information terminal, and more particular, a portable telephone or a sound reproduction device, it is desirable to drive the light emitting device so that the character information is formed by a light emitting portion while a non emission portion corresponds to the background.

As set forth above, the present invention can be applied variously to a wide range of electronic devices in all fields. The electronic device in the present embodiment can be obtained by utilizing a light emitting device having the configuration in which the structures in Embodiments 1 through 10 are freely combined.

Embodiment 12

In this embodiment, an example of applying the present invention to a liquid crystal display device is described. The structure of a pixel of the liquid crystal display device of the present invention shown in FIG. 21.

Figure 21:
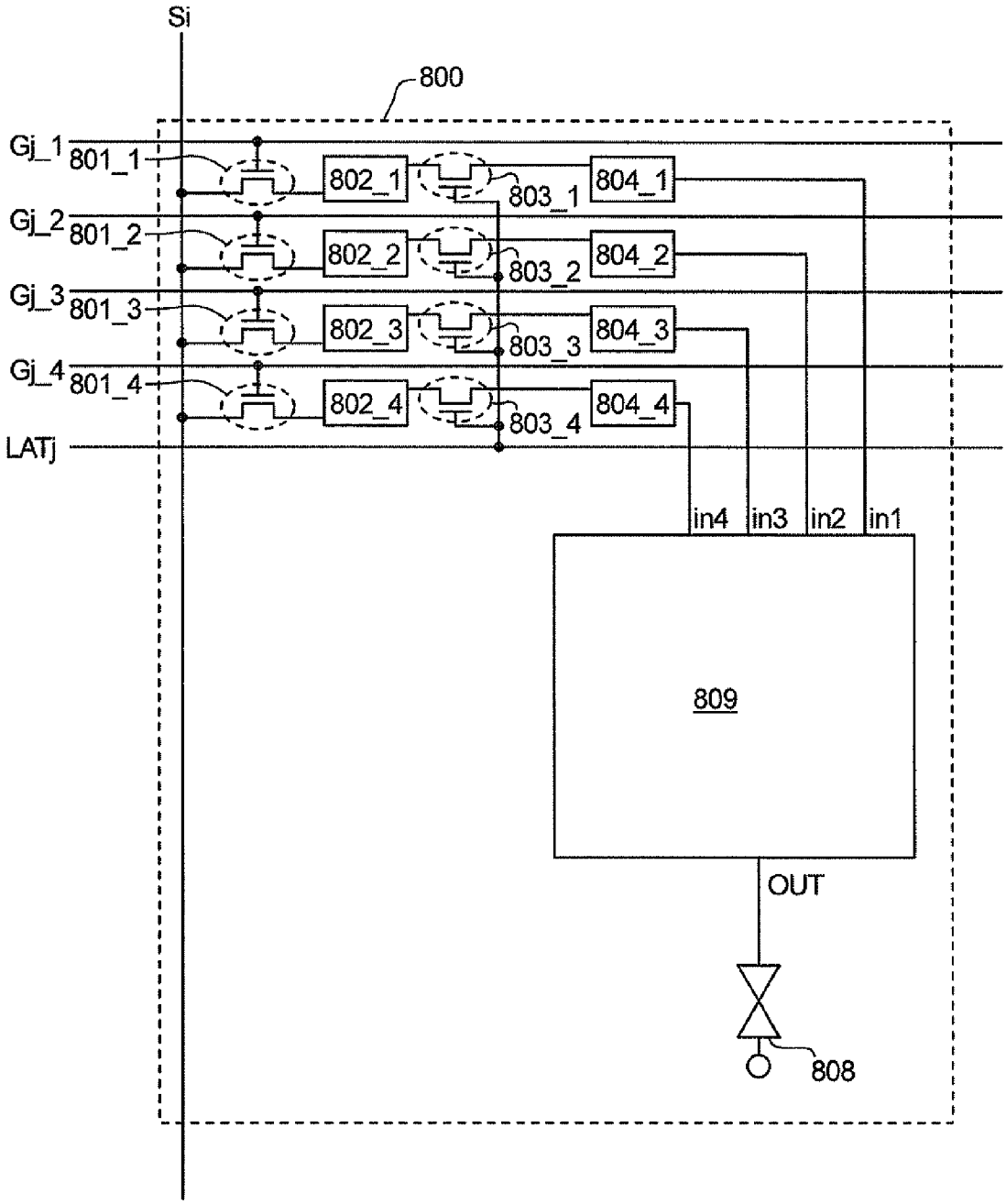
FIG. 21 is a circuit diagram of a pixel in a liquid crystal display device of Embodiment 12.

A pixel 800 shown in FIG. 21 has one source signal line Si (i is an arbitrary number ranging from 1 to x), and one latch signal line LATj (j is an arbitrary number ranging from 1 to y). The pixel also has gate signal lines Gj_1 to Gj_4 and the number of gate signal lines is the same as the bit number of the digital video signals (4, in this embodiment).

Each of the pixel 800 have first switching TFTs 801_1 to 801_4, first memories 802_1 to 802_4, second switching TFTs 803_1 to 803_4, and second memories 804_1 to 804_4, and the number of first switching TFTs, the number of first memories, the number of second switching TFTs, and the number of second memories are the same as the bit number of the digital video signals (4, in this embodiment).

All of second switching, TFTs 803_1 to 803_4 have the same polarity.

Further, each of the pixel 800 also has a liquid crystal cell driving unit 809 and a liquid crystal cell 808. The liquid crystal cell driving unit 809 is a unit for generating signals that turn the liquid crystal cell 808 ON only for a period determined by image information of digital video signals. Further, the liquid crystal cell turned ON in the present invention means that the transmission of the liquid crystal between the pixel electrode and the counter electrode is changed by generating a difference of voltage between the pixel electrode and the counter electrode of the liquid crystal cell.

Gate electrodes of the first switching TFTs 801_1 to 801_4 are connected to the gate signal lines Gj_1 to Gj_4, respectively. To elaborate, the gate electrode of the first switching TFT 801_1 is connected to the gate signal line Gj_1. The gate electrode of the first switching TFT 801_2 is connected to the gate signal line Gj_2. The gate electrode of the first switching TFT 801_3 is connected to the gate signal line Gj_3. The gate electrode of the first switching TFT 801_4 is connected to the gate signal line Gj_4.

One of the source regions or drain regions of the first switching TFTs 801_1 to 801_4 are connected to the source signal line Si, respectively. Of the source regions and the drain regions of the first switching TFTs, regions that are not connected to the source signal line Si are connected to input terminals of the first memories 802_1 to 802_4, respectively. To elaborate, one of the source region and the drain region of the first switching TFT 801_1 is connected to the source signal line Si whereas the other is connected to the input terminal of the first memory 802_1. One of the source region and the drain region of the first switching TFT 801_2 is connected to the source signal line Si whereas the other is connected to the input terminal of the first memory 802_2. One of the source region and the drain region of the first switching TFT 801_3 is connected to the source signal line Si whereas the other is connected to the input terminal of the first memory 802_3. To elaborate, one of the source region and the drain region of the first switching TFT 801_4 is connected to the source signal line Si whereas the other is connected to the input terminal of the first memory 802_4.

Gate electrodes of the second switching TFTs 803_1 to 803_4 are connected to the latch signal line LATj.

Source regions or drain regions of the second switching TFTs 803_1 to 803_4 are connected to output terminals of the first memories 802_1 to 802_4, respectively. Of the source regions and the drain regions of the second switching TFTs, regions that are not connected to the output terminals of the first memories are connected to input terminals of the second memories 804_1 to 804_4, respectively. To elaborate, one of the source region and the drain region of the second switching TFT 803_1 is connected to the output terminal of the first memory 802_1 whereas the other is connected to the input terminal of the second memory 804_1. One of the source region and the drain region of the second switching TFT 803_2 is connected to the output terminal of the first memory 802_2 whereas the other is connected to the input terminal of the second memory 804_2. One of the source region and the drain region of the second switching TFT 803_3 is connected to the output terminal of the first memory 802_3 whereas the other is connected to the input terminal of the second memory 804_3. One of the source region and the drain region of the second switching TFT 803_4 is connected to the output terminal of the first memory 802_4 whereas the other is connected to the input terminal of the second memory 804_4.

The liquid crystal cell driving unit 809 has input terminals (in1 to in4) and the number of input terminals is the same as the bit number of the digital video signals (4, in this embodiment). The input terminals are connected to output terminals of the second memories 804_1 to 804_4 on a one to one basis.

An output terminal (out) of the liquid crystal cell driving unit 809 is connected to a pixel electrode of the liquid crystal cell 808. The liquid crystal cell 808 has a pixel electrode, a counter electrode and a liquid crystal between the pixel electrode and the counter electrode.

In the liquid crystal device of this embodiment, similar to the case of the light emitting device, the digital video signal is written in sequentially the first memories 802_1 to 802_4, because the gate signal line Gj_1 to Gj_4 are sequentially selected so that the first switching TFTs 801_1 to 801_4 are sequentially turned ON. The second switching TFTs 803_1 to 803_4 turn simultaneously ON by the latch signal inputted to LATj, and the bit of the digital video signal retained in the first memories 102_1 to 102_4 are written in and retained in the second memories 104_1 to 104_4. The liquid crystal cell is turned ON by inputting the digital video signal retained in the second memories 104_1 to 104_4 only for a period determinedly the information of the digital video signal.

The electronic devices of this embodiment can use any structures of the light emitting devices shown in Embodiments 1 to 6, 8 and 11.

Embodiment 13

In this embodiment, an example of applying the present invention to the liquid crystal display device is described. The structure of the liquid crystal display device of the present invention is shown in FIG. 22.

Figure 22:
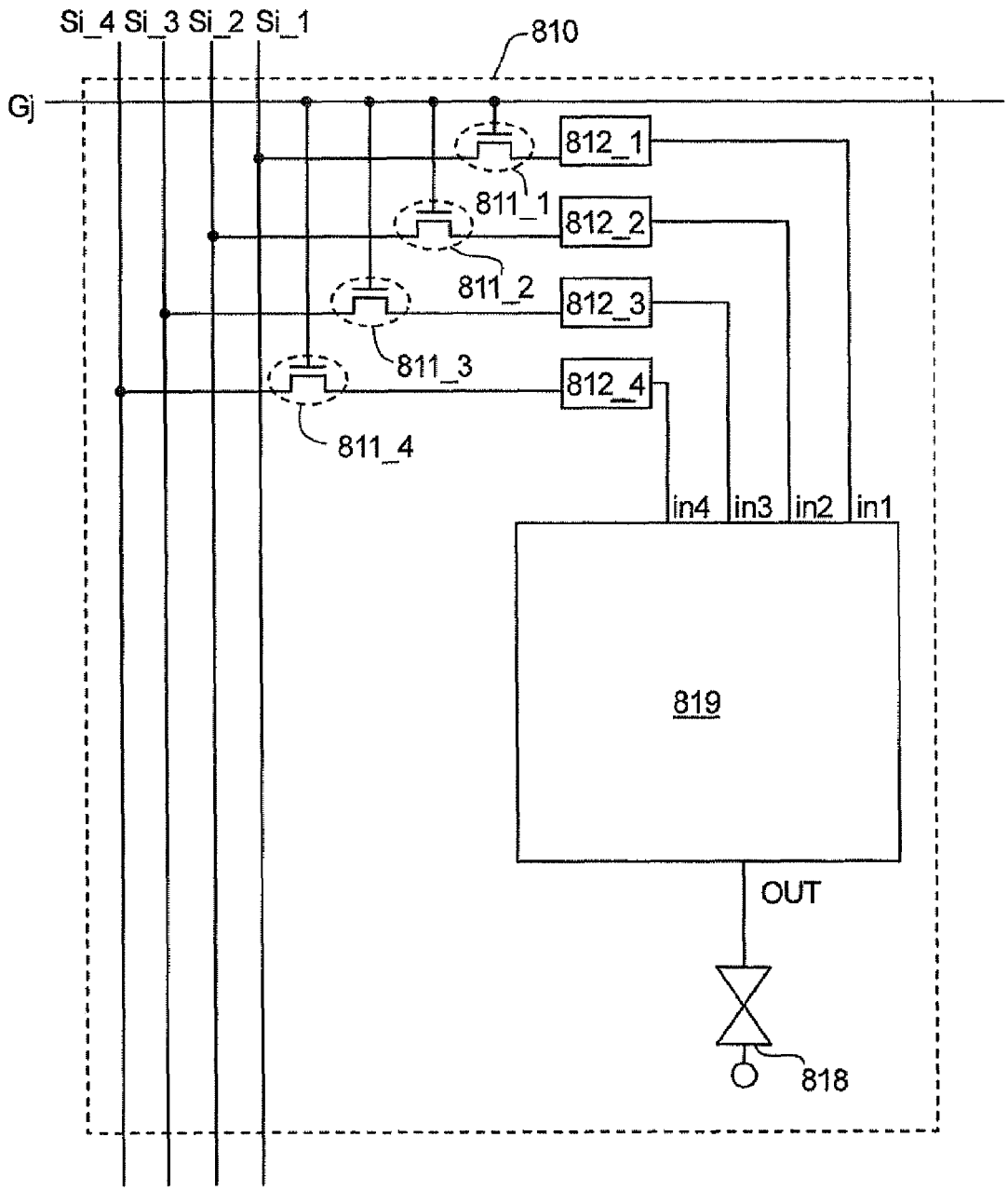
FIG. 22 is a circuit diagram of a pixel in a liquid crystal display device of Embodiment 13.

The pixel 810 shown in FIG. 22 has source signal lines Si_1 to Si_4 (i is an arbitrary number ranging from 1 to x) and the number of source signal lines are the same as the bit number of the digital video signals (4, in this embodiment), and one gate signal line Gj.

Each of the pixel 810 has switching TFTs 811_1 to 811_4 and memories 812_1 to 812_4 and the number of switching TFTs and memories are the same as the bit number of the digital video signals (4, in this embodiment). Further, all of the switching TFTs have the same polarity.

Further, each of the pixel 810 also has a liquid crystal cell driving unit 819 and a liquid crystal cell 818. The liquid crystal cell driving unit 819 is a unit for generating signals that turn the liquid crystal cell 818 ON only for a period determined by image information of digital video signals.

Gate electrodes of the switching TFTs 811_1 to 811_4 are connected to the gate signal line Gj.

Source regions or drain regions of the switching TFTs 811_1 to 811_4 are connected to the source signal line Si_1 to Si_4, respectively. Of the source regions and the drain regions of the switching TFTs, regions that are not connected to the source signal line Si_1 to Si_4 are connected to input terminals of the memories 812_1 to 812_4, respectively. To elaborate, one of the source region and the drain region of the first switching TFT 811_1 is connected to the source signal line Si_1 whereas the other is connected to the input terminal of the memory 812_1. One of the source region and the drain region of the switching TFT 811_2 is connected to the source signal line Si_2 whereas the other is connected to the input terminal of the memory 812_2. One of the source region and the drain region of the switching TFT 811_3 is connected to the source signal line Si_3 whereas the other is connected to the input terminal of the memory 812_3. To elaborate, one of the source region and the drain region of the switching TFT 811_4 is connected to the source signal line Si_4 whereas the other is connected to the input terminal of the memory 812_4.

The liquid crystal cell driving unit 819 has input terminals (in1 to in4) and the number of input terminals is the same as the bit number of the digital video signals (4, in this embodiment). The input terminals are connected to output terminals of the memories 812_1 to 812_4 on a one to one basis.

An output terminal (out) of the liquid crystal cell driving unit 819 is connected to a pixel electrode of the liquid crystal cell 818. The liquid crystal cell 818 has a pixel electrode, a counter electrode and a liquid crystal between the pixel electrode and the counter electrode.

In the liquid crystal device of this embodiment, similar to the case of the light emitting device, the digital video signal is written in sequentially the memories 812_1 to 812_4, because the gate signal line Gj are sequentially selected so that the switching TFTs 811_1 to 811_4 are sequentially turned ON. The liquid crystal cell is turned ON by inputting the digital video signal retained in the memories 812_1 to 812_4 to the liquid crystal cell driving unit 819 only for a period determined by information of the digital video signal.

The electronic devices of this embodiment can use any structures of the light emitting devices shown in Embodiments 1 to 6, 8 and 1.

In a light emitting device of the present invention, light emitting elements of plural pixels simultaneously become from the non-luminous state to the luminous state (emit light) only when a writing period is ended to start a light emission period. Accordingly, light emitting elements of plural pixels simultaneously start emitting light not more than once in one frame period whichever gradation is to be obtained. The number of times the luminance of light emitting elements is temporarily lowered, which is caused by light emitting elements of plural pixels simultaneously starting light emission, is thus controlled and flickers on the screen can be reduced.

Also, animation pseudocontour can be avoided because a light emitting element does not emit light in consecutive periods of consecutive frame periods when an intermediate gradation display is to be performed.

What is claimed is:

1. A method of driving a light emitting device, said light emitting device including a plurality of pixels, each of the plurality of pixels comprising:

n first memories (n is a natural number);

n second memories;

a display signal generating portion including n exclusive OR circuits, first NOR circuit, second NOR circuit, third NOR circuit and an inverter circuit, wherein each output of the n exclusive OR circuits is electrically connected to an input of the first NOR circuit, an output of the first NOR circuit is electrically connected to an input of the second NOR circuit, an output of the second NOR circuit is electrically connected to an input of the third NOR circuit and to an input of the inverter circuit, and an output of the third NOR circuit is electrically connected to an input of the second NOR circuit;

a counter circuit;

a light emitting element; and a current controlling thin film transistor, wherein an output of the inverter circuit is electrically connected to a gate electrode of the current controlling thin film transistor;

said method comprising the steps of:

sequentially writing each bit of n bit digital video signals in each of the n first memories;

writing each bit of the n bit digital video signals, which have been written in each of the n first memories, in each of the n second memories at once;

inputting each bit of the n bit digital video signals, which have been written in each of the n second memories, to each of the n exclusive OR circuits;

starting an output of n counter signals from the counter circuit in response to a first reset signal, the n counter signals having different frequencies from each other;

inputting each of the n counter signals to each of the n exclusive OR circuits; and inputting a display signal into the gate electrode of the current controlling thin film transistor in response to a second reset signal applied to an input of the third NOR circuit.

2. The method of driving the light emitting device according to claim 1, wherein each of the first memories and second memories is an SRAM.

3. The method of driving the light emitting device according to claim 1, wherein clock signals are inputted to the counter circuit, and wherein frequencies of the n counter signals arranged in order from highest to lowest correspond to 1/2, $1/2^2$, . . . , $1/2^n$ of frequencies of the clock signals, respectively.

4. The method of driving the light emitting device according to claim 1, wherein the light emitting device is in combination with an electronic apparatus, wherein the electronic apparatus is an electroluminescence display device.

5. The method of driving the light emitting device according to claim 1, wherein the light emitting element emits a light only during a period that starts with the start of the output of the n counter signals and ends as a plurality of first information of each bit of the n bit digital video signals inputted to the display signal generating portion matches a plurality of second information of each of the n counter signals.

* * * * *